US008098266B2

(12) United States Patent
Asai et al.

(10) Patent No.: US 8,098,266 B2
(45) Date of Patent: Jan. 17, 2012

(54) IMAGE PROCESSING METHOD AND IMAGE PROCESSING APPARATUS

(75) Inventors: Toshiaki Asai, Numazu (JP); Tomomi Ishimi, Numazu (JP); Shinya Kawahara, Numazu (JP); Yoshihiko Hotta, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 315 days.

(21) Appl. No.: 12/547,645

(22) Filed: Aug. 26, 2009

(65) Prior Publication Data

US 2010/0054106 A1 Mar. 4, 2010

(30) Foreign Application Priority Data

Aug. 28, 2008 (JP) ..... 2008-219726

(51) Int. Cl.
*B41J 2/315* (2006.01)
*B41J 29/16* (2006.01)

(52) U.S. Cl. ..... 347/171; 347/179

(58) Field of Classification Search ..... 347/171, 347/179, 189, 194, 224, 241, 244, 248, 253, 347/256

See application file for complete search history.

(56) References Cited

U.S. PATENT DOCUMENTS 5,537,138 A * 7/1996 Yamada et al. ..... 347/171
6,325,474 B1 * 12/2001 Betzold et al. ..... 347/224
6,330,524 B1 12/2001 Suzuki et al.
6,791,594 B2 * 9/2004 Takeuchi ..... 347/241
7,049,268 B2 5/2006 Sakata et al.
7,238,642 B2 7/2007 Shimbo et al.
7,338,919 B2 3/2008 Kawahara et al.
7,422,996 B2 9/2008 Shimbo et al.
7,439,993 B2 10/2008 Ishimi et al.
7,456,132 B2 11/2008 Yamamoto et al.
2007/0036039 A1 2/2007 Kawahara et al.
2007/0225162 A1 9/2007 Kawahara et al.
2007/0225163 A1 9/2007 Shimbo et al.
2008/0151033 A1 6/2008 Ishimi et al.

(Continued)

FOREIGN PATENT DOCUMENTS

EP 1752298 A1 2/2007

(Continued)

OTHER PUBLICATIONS

Feb. 26, 2010 European search report in connection with counterpart European patent application No. 09 16 8838.

*Primary Examiner* — Kristal Feggins
(74) *Attorney, Agent, or Firm* — Cooper & Dunham LLP

(57) ABSTRACT

An image processing method which contains: delivering laser light to a thermoreversible recording medium to heat the medium and record an image thereon, the medium reversibly changing a transparency or tone thereof depending on a temperature thereof; and heating the medium to erase the image recorded thereon, wherein the delivering is carried out using an image processing device containing: a laser light emitting unit; a light scanning unit disposed on a plane onto which laser light emitted from the laser light emitting unit is delivered; a light intensity distribution adjusting unit to change a light intensity distribution of the laser light; and a fθ lens to condense the laser light, and wherein energy of the laser light passing through a peripheric portion of the fθ lens and traveling onto the medium is lower than energy of the laser light passing through a center portion of the fθ lens and traveling onto the medium.

13 Claims, 9 Drawing Sheets

U.S. PATENT DOCUMENTS

| | | | |
|---|---|---|---|
| 2008/0153698 | A1 | 6/2008 | Kawahara et al. |
| 2008/0214391 | A1 | 9/2008 | Kawahara et al. |

FOREIGN PATENT DOCUMENTS

| | | |
|---|---|---|
| JP | 2000-136022 | 5/2000 |
| JP | 3350836 | 9/2002 |
| JP | 2003-127446 | 5/2003 |
| JP | 3446316 | 7/2003 |
| JP | 2003-246144 | 9/2003 |
| JP | 3682295 | 5/2005 |
| JP | 2006-126851 | 5/2006 |
| JP | 2007-69605 | 3/2007 |
| JP | 2008-68630 | 3/2008 |

* cited by examiner

IMAGE PROCESSING METHOD AND IMAGE PROCESSING APPARATUS

BACKGROUND OF THE INVENTION

1. Field of the Invention

The present invention relates to an image processing method which prevents deterioration of a thermoreversible recording medium by reducing the damages due to repetitive recording and erasing of images, and an image processing device suitably which can be suitably used for the image processing method.

2. Description of the Related Art

As a method for recording and erasing an image onto and from a thermoreversible recording medium (hereinafter otherwise referred to as "reversible thermosensitive recording medium", "recording medium" or "medium") from a distance or when depressions and protrusions are created on the surface of the thermoreversible recording medium, there has been proposed a method using a noncontact laser (refer to Japanese Patent Application Laid-Open (JP-A) No. 2000-136022). This proposal discloses that image recording is carried out using a laser and image erasing is carried out using hot air, warm water, an infrared heater or the like.

Moreover, Japanese Patent (JP-B) No. 3350836 discloses that by controlling at least one of the irradiation time, the irradiation luminosity, the focus and the intensity distribution, it is possible to control the heating temperature in a manner that is divided into a first specific temperature and a second specific temperature of the thermoreversible recording medium, and by changing the cooling rate after heating, it is possible to form and erase an image on the whole surface or partially.

JP-B No. 3446316 describes use of two laser beams and the following methods: a method in which erasure is carried out with one laser beam being used as an elliptical or oval laser beam, and recording is carried out with the other laser beam being used as a circular laser beam; a method in which recording is carried out with the two laser beams being used in combination; and a method in which recording is carried out, with each of the two laser beams being modified and then these modified laser beams being used in combination. According to these methods, use of the two laser beams makes it possible to realize higher density image recording than use of one laser beam does.

Moreover, JP-A No. 2003-246144 proposes the method for realizing an image recording with high durability on a thermoreversible recording medium, in which an image of clear contrast can be recorded by erasing with laser light the energy and irradiation time of which are controlled to be 25% to 65% of the laser light used at the time of recording.

According to the conventional methods mentioned above, image recording and erasing can be carried out repeatedly using laser. However, as laser is not controlled, there is a problem such that a thermal damage is occurred locally on the area where lines are overlapped at the time of image recording.

In this connection, for example, JP-A No. 2003-127446 proposes to prevent the deterioration of a thermoreversible recording medium by lowering the energy at a certain interval at the time a straight line is recorded so as to reduce a local thermal damage. Moreover, JP-A No. 2007-69605 discloses that energy is uniformly applied to a thermoreversible recording medium by controlling the light intensity at the center portion to the same degree or less of the that in the peripheric portion in the light intensity distribution on the cross section in the substantially orthogonal direction with respect to the traveling direction of laser light, and thus deterioration of the thermoreversible recording medium is reduced even when image recording and erasing are repeated.

Moreover, Japanese Patent No. 3682295 and JP-A No. 2006-126851 proposes an image recording device which enables to irradiate a large area of a thermoreversible recording medium using a galvanometer mirror as a light scanning unit, and a fθ lens as a light condensing unit. However, in this proposal, aberrations are caused because the galvanometer mirror and the fθ lens are used, and a thermoreversible recording medium is deteriorated if image recording and erasing are repeatedly carried out with changing the scanning linear speed.

To solve the aforementioned problems, for example JP-A No. 2008-68630 discloses a method in which the light intensity distribution of laser light transmitting through the center portion of a fθ lens and traveling onto a thermoreversible recording medium is controlled so that excessive energy is not applied on the thermoreversible recording medium, even when the scanning linear speed is changed with the combination of an optical system using a galvanometer mirror and the fθ lens, and an optical lens as a light intensity distribution controlling unit for controlling the light intensity of laser light. According to this proposal, even when image recording and erasing are repeated with laser, the laser light transmitting through the center part of the fθ lens and traveling on the thermoreversible recording medium is not easily cause the deterioration of the thermoreversible recording medium.

However, according to the technique disclosed in JP-A No. 2008-68630, the light intensity distribution of the laser light passing through the peripheric portion of the fθ lens and traveling onto the thermoreversible recording medium becomes sharp in its shape compared to that of the laser light passing through the center portion of the fθ lens and traveling onto the thermoreversible recording medium, and as a result, the laser light partially having large intensity compared to the laser light passing through the center portion of the fθ lens and traveling to the thermoreversible recording medium is transmitted through the peripheric portion of the fθ lens and delivered to the thermoreversible recording medium. If image recording and erasing are repetitively performed in this condition, the thermoreversible recording medium will be deteriorated at an early stage.

Accordingly, there is currently no image processing method and no image processing device which suppress the deterioration of a thermoreversible recording medium when image recording and erasing are repeatedly performed, without applying excessive energy to the thermoreversible recording medium from laser light passing through a center portion of a fθ lens and traveling onto the thermoreversible recording medium, and laser light passing through a peripheric portion of the fθ lens and traveling onto the thermoreversible recording medium, and also are capable of uniformly recording an image. For this reason, it is a situation that such image processing method and image processing device are desired.

BRIEF SUMMARY OF THE INVENTION

The present invention aims at providing an image processing method and image processing device both of which suppress the deterioration of a thermoreversible recording medium when image recording and erasing are repeatedly performed, without applying excessive energy to the thermoreversible recording medium from laser light passing through a center portion of a fθ lens and traveling onto the thermoreversible recording medium, and laser light passing through a peripheric portion of the fθ lens and traveling onto the thermoreversible recording medium, and also are capable of uniformly recording an image.

Means for solving the aforementioned problems are as follow:

<1> An image processing method containing: delivering laser light to a thermoreversible recording medium so as to heat the thermoreversible recording medium and record an image thereon, the thermoreversible recording medium reversibly changing a transparency or tone thereof depending on a temperature thereof; and heating the thermoreversible recording medium so as to erase the image recorded on the thermoreversible recording medium, wherein the delivering is carried out using an image processing device which contains: a laser light emitting unit; a light scanning unit disposed on a plane onto which laser light emitted from the laser light emitting unit is delivered; a light intensity distribution adjusting unit configured to change a light intensity distribution of the laser light; and a fθ lens configured to condense the laser light, and wherein energy of the laser light which passes through a peripheric portion of the fθ lens and travels onto the thermoreversible recording medium is lower than energy of the laser light which passes through a center portion of the fθ lens and travels onto the thermoreversible recording medium.

<2> The image processing method according to <1>, wherein output P2 of the laser light which passes through the peripheric portion of the fθ lens and travels onto the thermoreversible recording medium is adjusted to be lower than output P1 of the laser light which passes through the center portion of the fθ lens and travels onto the thermoreversible recording medium.

<3> The image processing method according to <2>, wherein the value of (P2/P1)×100 is 80% to 99%.

<4> The image processing method according to <1>, wherein a scanning linear velocity V2 of the laser light which passes through the peripheric portion of the fθ lens and travels onto the thermoreversible recording medium is adjusted to be faster than a scanning linear velocity V1 of the laser light which passes through the center portion of the fθ lens and travels onto the thermoreversible recording medium.

<5> The image processing method according to <4>, wherein the value of (V2/V1)×100 is 101% to 120%.

<6> The image processing method according to any one of <1> to <5>, wherein in both the irradiating and the heating, or in the irradiating or the heating, a light intensity distribution of the laser light which passes through the center portion of the fθ lens and travels onto the thermoreversible recording medium satisfies the following formula 1:

$$0.40 \leqq I_1/I_2 \leqq 2.00 \qquad \text{Formula 1}$$

where $I_1$ is a light intensity at a center part of the laser light delivered onto the thermoreversible recording medium, and $I_2$ is a light intensity at a plane which defines 80% of a total radiation energy of the laser beam delivered onto the thermoreversible recording medium in the light intensity distribution.

<7> The image processing method according to any one of <1> to <6>, wherein the thermoreversible recording medium contains a support and a thermoreversible recording layer disposed on the support, and wherein the thermoreversible recording layer is configured to reversibly change a transparency or tone thereof at a first specified temperature and a second specified temperature which is higher than the first specified temperature.

<8> The image processing method according to <7>, wherein the thermoreversible recording layer contains a resin and a low-molecular organic material.

<9> The image processing method according to <7>, wherein the thermoreversible recording layer comprises a leuco dye and a reversible developer.

<10> The image processing method according to any one of <1> to <9>, which is used for image recording, or image erasing, or both of image recording and image erasing, on a moving object.

<11> An image processing device containing: a laser light emitting unit; a light scanning unit disposed on a plane where laser light is traveled from the laser light irradiating unit; a light intensity distribution adjusting unit configured to change a light intensity distribution of the laser light; and a fθ lens configured to condense the laser light, and wherein energy of the laser light which passes through a peripheric portion of the fθ lens and travels onto the thermoreversible recording medium is lower than energy of the laser light which passes through a center portion of the fθ lens and travels onto the thermoreversible recording medium, wherein the image processing device is used for the image processing method as defined any one of <1> to <10>.

<12> The image processing device according to <11>, wherein the light intensity adjusting unit is at least one selected from the group consisting of an aspherical lens, a diffraction optical element, and a fiber coupling.

<13> The image processing device according to any of <11> or <12>, wherein the light scanning unit is a galvanometer mirror.

According to the present invention, various problems in the conventional art can be solved, and there can be provided an image processing method and image processing device both of which suppress the deterioration of a thermoreversible recording medium when image recording and erasing are repeatedly performed, without applying excessive energy to the thermoreversible recording medium from laser light passing through a center portion of a fθ lens and traveling onto the thermoreversible recording medium, and laser light passing through a peripheric portion of the fθ lens and traveling onto the thermoreversible recording medium, and also are capable of uniformly recording an image.

Figure 1:
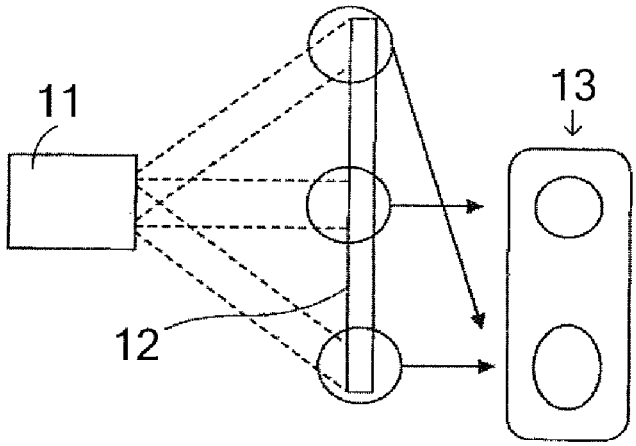
FIG. 1 is a diagram showing a relationship between the position of a laser head and the change in the shape of the laser beam on the medium.

DETAILED DESCRIPTION OF THE INVENTION (Image Processing Method)

An image processing method of the present invention includes at least one of an image recording step and an image erasing step, and further includes other steps suitably selected in accordance with the necessity.

The image processing method of the present invention includes all of the following aspects: an aspect in which both recording and erasure of an image are performed, an aspect in which only recording of an image is performed, and an aspect in which only erasure of an image is performed.

In the present invention, the image include a character(s), a symbol(s), a diagram(s) and a figure(s).

<Image Recording Step and Image Erasing Step>

The image recording step in the image processing method of the present invention is delivering laser light so as to heat a thermoreversible recording medium and record an image onto the thermoreversible recording medium that changes transparency or tone thereof depending on the temperature.

The image erasing step in the image processing method of the present invention is heating the thermoreversible recording medium so as to erase the recorded image on the thermoreversible recording medium.

By delivering the laser beam so as to heat the thermoreversible recording medium, it is possible to record and erase an image onto the thermoreversible recording medium in a non-contact manner.

In the image processing method of the present invention, normally, an image is renewed for a first time when the thermoreversible recording medium is reused (the above-mentioned image erasing step), then an image is recorded by the image recording step; however, recording and erasing of an image do not necessarily have to follow this order, and an image may be recorded by the image recording step first and then erased by the image erasing step.

In the present invention, the image recording step is performed by means of an image processing device which contains a laser light emitting unit, a light scanning unit disposed on the plane to which the laser light emitted from the laser light emitting unit is delivered, a light intensity distribution adjusting unit configured to change a light intensity distribution of the laser light, and a fθ lens configured to condense the laser light. The details of the image processing unit will be explained later.

The energy of the laser light that passes through the peripheric portion of the fθ lens and then travels onto the thermoreversible recording medium is adjusted to be lower than the energy of the laser light that passes through the center portion of the fθ lens and then travels onto the thermoreversible recording medium. As a result of this adjustment, as excessive energy is not applied onto the thermoreversible recording medium, the deterioration of the thermoreversible recording medium can be suppressed even when image recording and erasing are repeatedly performed.

The energy means an amount of the energy of the laser light delivered on the thermoreversible recording medium per unit length in the scanning direction, and is a property corresponding to P/V, where P is an output of the laser light, and V is a scanning linear velocity of the laser light. The energy increases as the output of the laser light increases, and the energy decreases as the scanning linear velocity of the laser light increases.

Figure 3A:
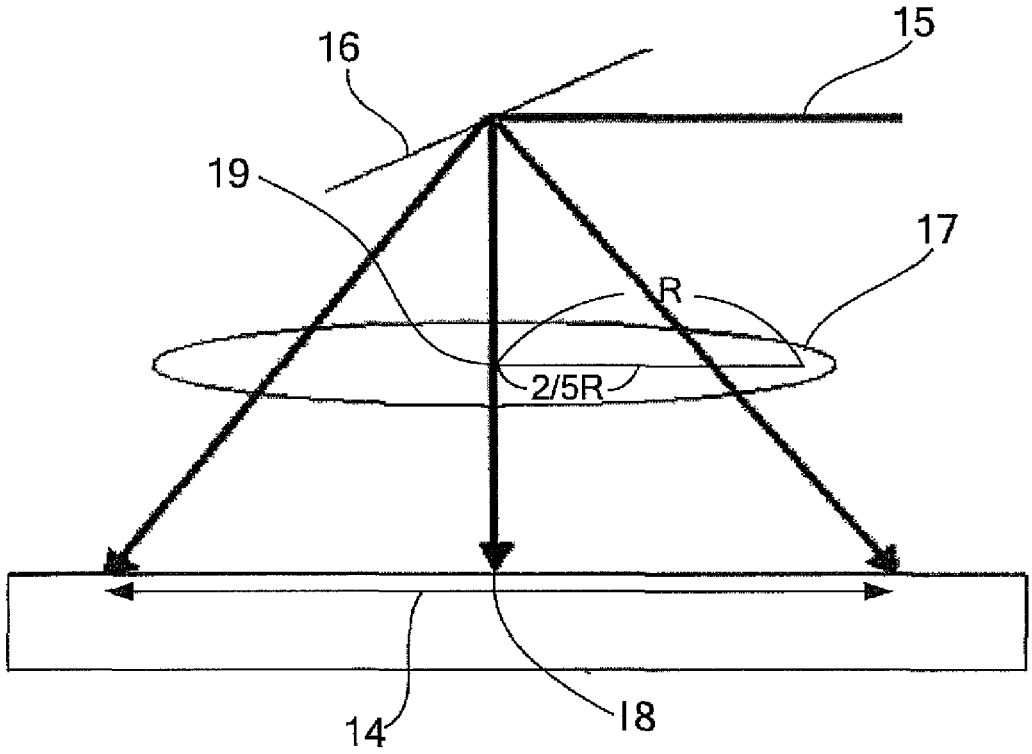
FIG. 3A is a diagram for explaining the area where laser light can illuminate.
Figure 3B:
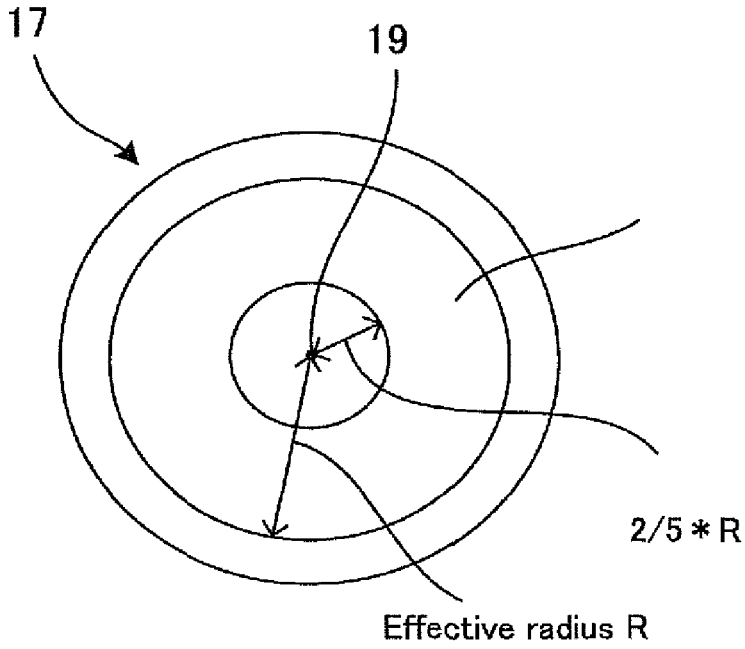
FIG. 3B is a diagram illustrating a fθ lens shown in FIG. 3A.

Here, "the center portion 17 of the fθ lens" means, as shown in FIGS. 3A and 3B, within the area 14 of the thermoreversible recording medium where laser light 15 can illuminate through the control by a mirror 16 disposed in an image processing device equipped with a laser light source, the region which is from a center point 19 of the irradiated portion with the laser light to ⅖·R (R represents an effective radius of the fθ lens). As shown in FIG. 3, "the center point 18 of the irradiated portion with the laser light" means the area which is illuminated by the laser beam vertically emitted from the laser head to the thermoreversible recording medium. The area of the center point 18 of the irradiated portion with the laser light is changed depending on a spot size of the laser light for use.

Figure 2:
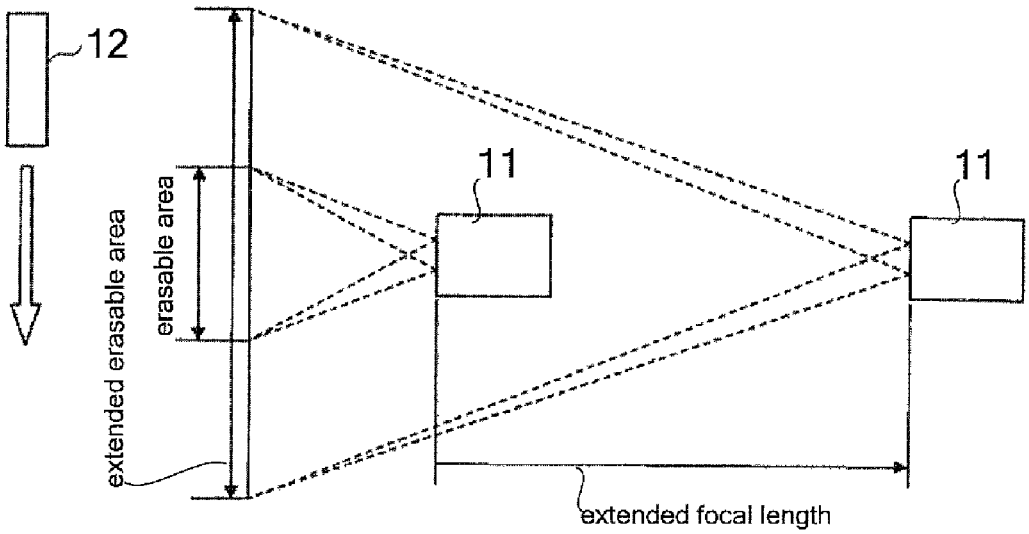
FIG. 2 is a diagram showing a relationship between a focal length of the laser head and the recording medium and the erasable region.

Also as shown in FIGS. 3A and 3B, "the peripheric portion of the fθ lens 17" means within the area 14 of the thermoreversible recording medium where laser light 15 can illuminate through the control by a mirror (a scanning mirror) 16 disposed in an image processing device equipped with a laser light source, the region other than the center portion of the fθ lens 17. The area of the peripheric portion is changed depending on the distance between the thermoreversible recording medium and a light source of the laser light (see FIGS. 1 to 3). Note that, in FIGS. 1 to 2, the numerical references 11, 12 and 13 represent a laser head, a thermoreversible recording medium, and the shape of the laser beam on the thermoreversible recording medium, respectively.

The effective radius of the fθ lens means a radius of the portion of the fθ lens where functions as a lens Examples of the method for lowering the energy of the laser light passing through the peripheric portion of the fθ lens and traveling onto the thermoreversible recording medium than the energy of the laser light passing through the center portion of the fθ lens and traveling onto the thermoreversible recording medium include the following methods (1) and (2):

(1) A method in which the output P2 of the laser light passing through the peripheric portion of the fθ lens and traveling onto the thermoreversible recording medium is adjusted to be lower than the output P1 of the laser light passing through the center portion of the fθ lens and traveling onto the thermoreversible recording medium; and (2) A method in which the scanning linear velocity V2 of the laser light passing through the peripheric portion of the fθ lens and traveling onto the thermoreversible recording medium is adjusted to be larger than the scanning linear velocity V1 of the laser light passing through the center portion of the fθ lens and traveling onto the thermoreversible recording medium.

These methods may be used individually, or in combination.

The method (1) realizes to suppress the deterioration of the thermoreversible recording medium due to the repetitive image recording and erasing, as excessive energy is not applied to the thermoreversible recording medium, by lowering the output P2 of the laser light passing through the peripheric portion of the fθ lens and traveling onto the thermoreversible recording medium than the output P1 of the laser light passing through the center portion of the fθ lens and traveling onto the thermoreversible recording medium.

The value of (P2/P1)×100 is preferably 80% to 99%, more preferably 85% to 95%, and yet more preferably 88% to 92%. When the value of the formula: (P2/P1)×100 is less than 80%, even though the laser light passing through the peripheric portion of the fθ lens and traveling onto the thermoreversible recording medium improves the resistance of the exposed area of the thermoreversible recording medium to the laser light against the repetitive image recording and erasing, there are problems such that a line width of an image is narrowed, and a line of an image is shown uncontinuously. When the value of the formula: (P2/P1)×100 is more than 99%, the laser light passing through the peripheric portion of the fθ lens and traveling onto the thermoreversible recording medium applies excessive energy to the exposed area of the thermoreversible recording medium, causing the deterioration of the thermoreversible recording medium, and lowering the resistance to the repetitive use.

The output of the laser beam applied in the image recording step is suitably selected depending on the intended purpose without any restriction; however, it is preferably 1 W or greater, more preferably 3 W or greater, and even more preferably 5 W or greater. When the output of the laser beam is less than 1 W, it takes a long time to record an image, and if an attempt is made to reduce the time spent on image recording, a high-density image cannot be obtained because of a lack of output.

Additionally, the upper limit of the output of the laser beam is suitably selected depending on the intended purpose without any restriction; however, it is preferably 200 W or less, more preferably 150 W or less, and even more preferably 100 W or less. When the output of the laser beam is greater than 200 W, it leads to an increase in the size of a laser device.

In the method (2), the deterioration of the thermoreversible recording medium due to the repetitive image recording and erasing can be reduced by making the scanning linear velocity V2 of the laser light passing through the peripheric portion of the fθ and traveling onto the thermoreversible recording medium larger than the scanning linear velocity V1 of the laser light passing through the center portion of the fθ lens and traveling onto the thermoreversible recording medium, as excessive energy is not applied to the thermoreversible recording medium.

The value of (V2/V1)×100 is preferably 101% to 120%, more preferably 105% to 115%, yet more preferably 108% to 112%. When the value of (V2/V1)×100 is less than 101%, the laser light passing through the peripheric portion of the fθ lens and traveling onto the thermoreversible recording medium applies excessive energy to the irradiated portion of the thermoreversible recording medium, lowing the repeating durability thereof. When the value thereof is more than 120%, even though the repeating durability of the irradiated portion of the thermoreversible recording medium with the laser light passing through the peripheric portion of the fθ lens and traveling onto the thermoreversible recording medium, a line width of an image is narrowed, and a line of an image is shown uncontinuously.

The scanning speed of the laser beam applied in the image recording step is suitably selected depending on the intended purpose without any restriction; however, it is preferably 300 mm/s or greater, more preferably 500 mm/s or greater, and even more preferably 700 mm/s or greater.

When the scanning speed is less than 300 mm/s, it takes a long time to record an image. Additionally, the upper limit of the scanning speed of the laser beam is suitably selected depending on the intended purpose without any restriction; however, it is preferably 15,000 mm/s or less, more preferably 10,000 mm/s or less, and even more preferably 8,000 mm/s or less. When the scanning speed is higher than 15,000 mm/s, it is difficult to record a uniform image.

The spot diameter of the laser beam applied in the image recording step is suitably selected depending on the intended purpose without any restriction; however, it is preferably 0.02 mm or greater, more preferably 0.1 mm or greater, and even more preferably 0.15 mm or greater. Additionally, the upper limit of the spot diameter of the laser beam is suitably selected depending on the intended purpose without any restriction; however, it is preferably 3.0 mm or less, more preferably 2.5 mm or less, and even more preferably 2.0 mm or less.

When the spot diameter is small, the line width of an image is also thin, and the contrast of the image lowers, thereby causing a decrease in visibility. When the spot diameter is large, the line width of an image is also thick, and adjacent lines overlap, thereby making it impossible to print small letters/characters.

For measuring a light intensity distribution of the laser light at the cross section orthogonal to the traveling direction of the laser light, a laser beam profiler using CCD etc. can be used when the laser light is emitted from, for example, a semiconductor laser, YAG laser or the like and has a wavelength in the near infrared region. When the laser light is emitted from, for example, a $CO_2$ laser and has a wavelength in the far infrared region, the aforementioned CCD cannot be used, and thus a combination of a beam splitter and a power meter, or a high power beam analyzer using a high sensitive pyroelectric camera, or the like can be used.

It is preferable that the light intensity distribution of the laser light passing through the center portion of the fθ lens and traveling onto the thermoreversible recording medium satisfies the relationship of $0.40 \leqq I_1/I_2 \leqq 2.00$ in at least one of the image recording step and the image erasing step. Note that, $I_1$ is a light intensity of the central location of the laser light traveling onto the thermoreversible recording medium, and $I_2$ is a light intensity of a 80% plane of the total radiation energy of the laser light traveling onto the thermoreversible recording medium.

Figure 4:
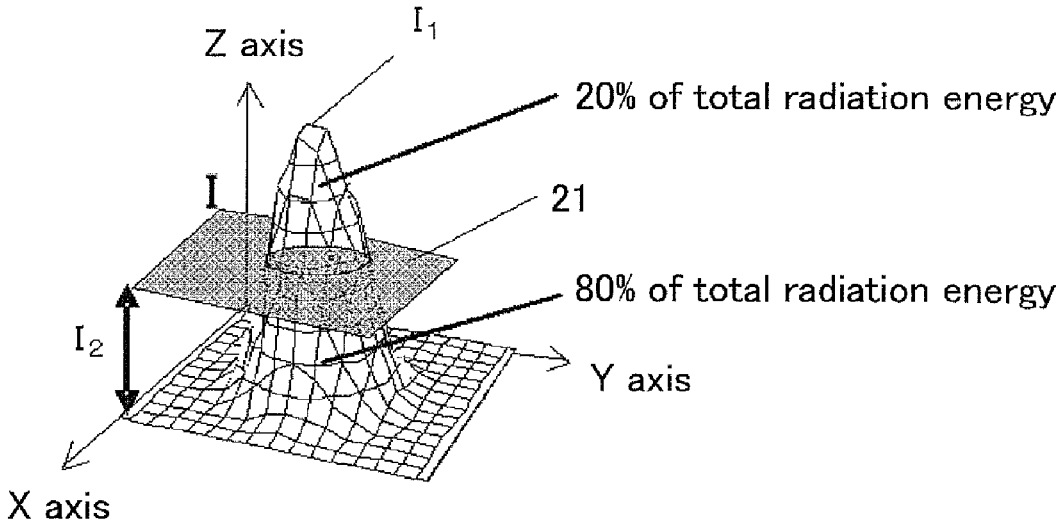
FIG. 4 is a schematic explanatory diagram showing one example of the light intensity distribution of the laser light for use in the present invention.

Here, "the 80% plane of the total radiation energy of the laser light traveling onto the thermoreversible recording medium" means, as shown in FIG. 4, a plane 21 which is a horizontal plane to the plane of Z=0, and divides the light intensity distribution so as to include 80% of the total radiation energy. This plane is obtained by measuring the light intensity of the laser light passing through the center portion of the fθ lens and traveling onto the thermoreversible recording medium by a high powder beam analyzed using a high sensitive pyroelectric camera, and profiling the obtained light intensity into a three-dimensional graph.

Figure 5A:
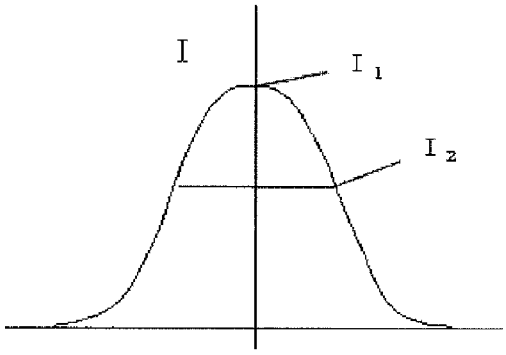
FIG. 5A is a schematic explanatory diagram showing one example of the light intensity distribution when the light intensity distribution of the laser light is changed.
Figure 5B:
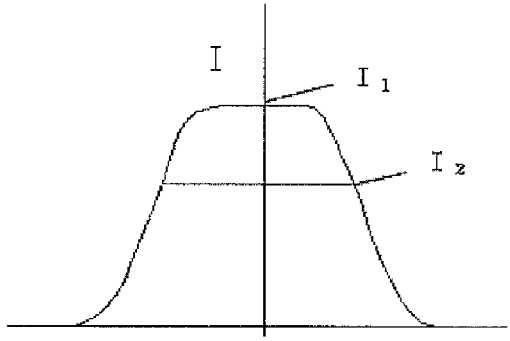
FIG. 5B is a schematic explanatory diagram showing one example of the light intensity distribution when the light intensity distribution of the laser light is changed.
Figure 5C:
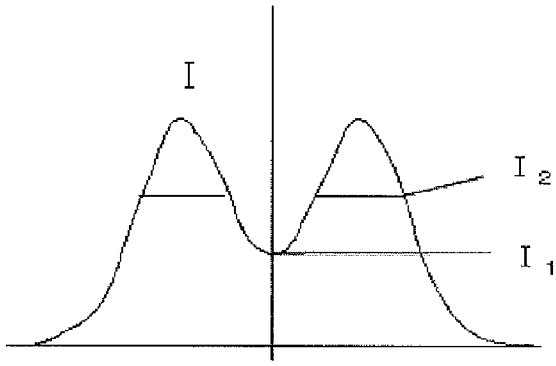
FIG. 5C is a schematic explanatory diagram showing one example of the light intensity distribution when the light intensity distribution of the laser light is changed.
Figure 5D:
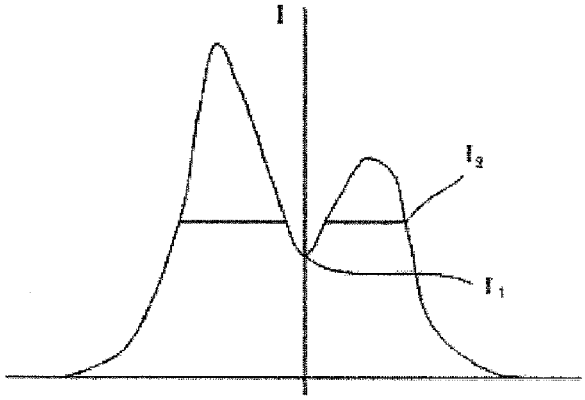
FIG. 5D is a schematic explanatory diagram showing one example of the light intensity distribution which is the distorted light intensity distribution of the laser light of FIG. 5C due to aberration.
Figure 5E:
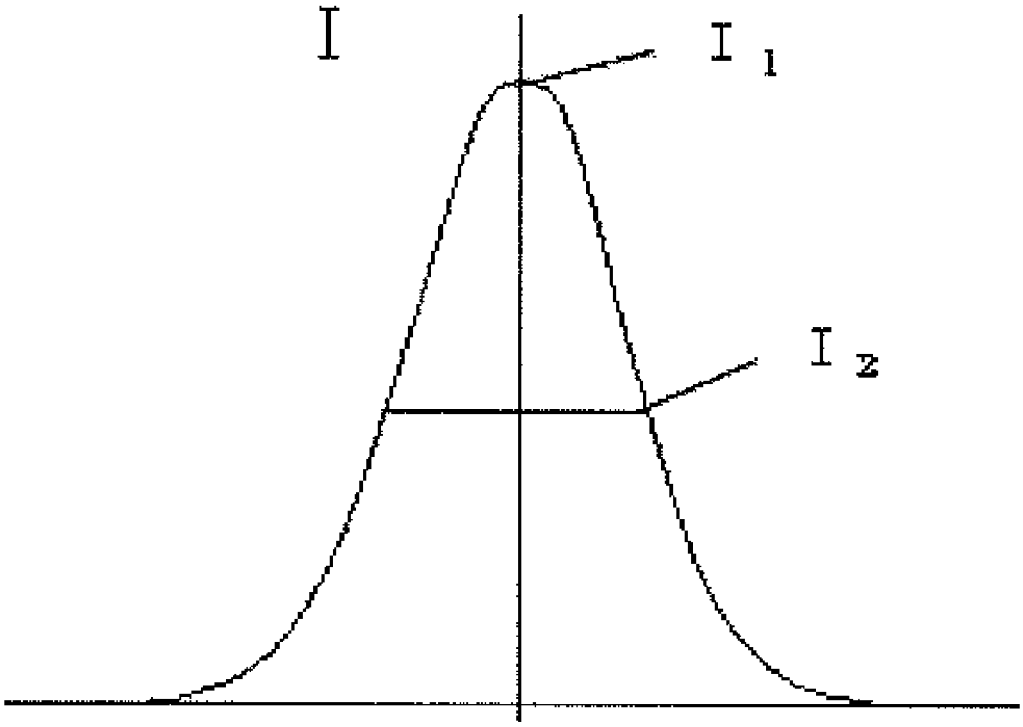
FIG. 5E is a schematic explanatory diagram showing the light intensity distribution (Gauss distribution) of normal laser light.

Examples of a light intensity distribution curve at the cross section including the maximum value of the laser light when the intensity distribution of the laser light traveling onto the thermoreversible recording medium is changed are shown in FIGS. 5A to 5E. FIG. 5E shows Gauss distribution, and in such the light intensity distribution in which the light intensity of the center portion is high, $I_2$ becomes smaller compared with $I_1$ and thus the value of $I_1/I_2$ becomes large. In the light intensity distribution in which the center portion of the light intensity is lower compared to the light intensity distribution of FIG. 5E, such as the case shown in FIG. 5A, $I_2$ becomes larger against $I_1$ and thus the value of $I_1/I_2$ becomes smaller than that of the light intensity distribution of FIG. 5E. In the light intensity distribution shaping like a top-hat as shown in FIG. 5B, $I_2$ becomes much larger against $I_1$ and thus the value of $I_1/I_2$ becomes much smaller than that of the light intensity distribution of FIG. 5A. In the light intensity distribution in which the center portion of the light intensity is small and surrounding portions of the light intensity are strong such as the case shown in FIG. 5C, $I_2$ becomes much larger against $I_1$, and the value of $I_1/I_2$ becomes much smaller than that of the light intensity distribution of FIG. 5B. Accordingly, it can be said that the ratio $I_1/I_2$ represents is the shape of the light intensity distribution of the laser light.

In the present invention, when the ratio $I_1/I_2$ is more than 2.00, the center portion of the light intensity becomes strong, excessive energy is applied to the thermoreversible recording medium, and as a result some of an image may be remained without being erased due to the deterioration of the thermoreversible recording medium after the repetitive image recording. When the ratio $I_1/I_2$ is less than 0.40, energy is not applied to the center portion compared to the peripheric portion, a center portion of an image is not colored when the image is recorded, and the line is separated into two. If the radiation energy is increased so as to color the center portion of the line, the light intensity of the peripheric portion becomes to high, excessive energy is applied thereto, and some of the image is remained without being erased at the time of image erasing due to the deterioration of the thermoreversible recording medium.

Moreover, when the ratio $I_1/I_2$ is more than 1.59, the light intensity distribution becomes the one in which the center portion of the light intensity is higher than the surrounding portions of the light intensity, a thickness of a drawing line can be changed by adjusting the radiation power without changing the radiation distance at the same time as suppressing the deterioration of the thermoreversible recording medium due to the repetitive image recording and erasing. In the present invention, the lower limit of the aforementioned ratio is preferably 0.40, more preferably 0.50, yet more preferably 0.60, yet even more preferably 0.70. In the present invention, the upper limit of the aforementioned ratio is preferably 2.00, more preferably 1.90, yet more preferably 1.80, yet even more preferably 1.70.

A method for changing the light intensity distribution of the laser light from Gauss distribution to the one in which the light intensity $I_1$ of the center location of the laser light and the light intensity $I_2$ at the 80% plane of the total radiation energy of the laser light satisfies the relationship of $0.40 \leqq I_1/I_2 \leqq 2.00$ is suitably selected depending on the intended purpose without any restriction. For example, the method using a light intensity adjusting unit is particularly preferable.

Even though the light intensity distribution of the laser light passing through the center portion of the fθ lens and traveling onto the thermoreversible recording medium is adjusted so as to satisfy the relationship of $0.40 \leqq I_1/I_2 \leqq 2.00$, the shape of the light intensity distribution of the laser light passing through the center portion of the fθ lens and traveling onto the thermoreversible recording medium differs from that of the laser light passing through the peripheric portion of the fθ lens and traveling onto the thermoreversible recording medium resulted from the use of an optical lens. For example, the laser light passing through the center portion of the fθ lens and traveling onto the thermoreversible recording medium is adjusted to as to have the light intensity distribution as shown in FIG. 5C, but the light intensity distribution of the laser light passing through the peripheric portion of the fθ lens and traveling onto the thermoreversible recording medium is changed to the one having a partially high intensity as shown in FIG. 5D. As a result, the irradiated portion of the thermoreversible recording medium wish the laser light passing through the peripheric portion of the fθ lens and traveling onto the thermoreversible recording medium is deteriorated faster than the irradiated portion thereof with the laser light passing through the center portion of the fθ lens and traveling onto the thermoreversible recording medium. Therefore, in order to suppress the deterioration, in the present invention, the output of the laser light passing through the peripheric portion of the fθ lens and traveling onto the thermoreversible recording medium is adjusted to be lower than that of the laser light passing through the center portion of the fθ lens and traveling onto the thermoreversible recording medium, or the scanning linear velocity of the laser light passing through the peripheric portion of the fθ lens and traveling onto the thermoreversible recording medium is adjusted to be higher than that of the laser light passing through the center portion of the fθ lens and traveling onto the thermoreversible recording medium.

<Image Recording and Image Erasing Mechanism>

The image recording and image erasing mechanism includes an aspect in which transparency reversibly changes depending upon temperature, and an aspect in which color tone reversibly changes depending upon temperature.

In the aspect in which transparency reversibly changes depending upon temperature, the low-molecular organic material in the thermoreversible recording medium is dispersed in the form of particles in the resin, and the transparency reversibly changes by heat between a transparent state and a white turbid state.

The change in the transparency is viewed based upon the following phenomena. In the case of the transparent state (1), particles of the low-molecular organic material dispersed in a resin base material and the resin base material are closely attached to each other without spaces, and there is no void inside the particles; therefore, a beam that has entered from one side permeates to the other side without diffusing, and thus the thermoreversible recording medium appears transparent. Meanwhile, in the case of the white turbid state (2), the particles of the low-molecular organic material are formed by fine crystals of the low-molecular organic material, and there are spaces (voids) created at the interfaces between the crystals or the interfaces between the particles and the resin base material; therefore, a beam that has entered from one side is refracted at the interfaces between the voids and the crystals or the interfaces between the voids and the resin and thereby diffuses, and thus the thermoreversible recording medium appears white.

Figure 7A:
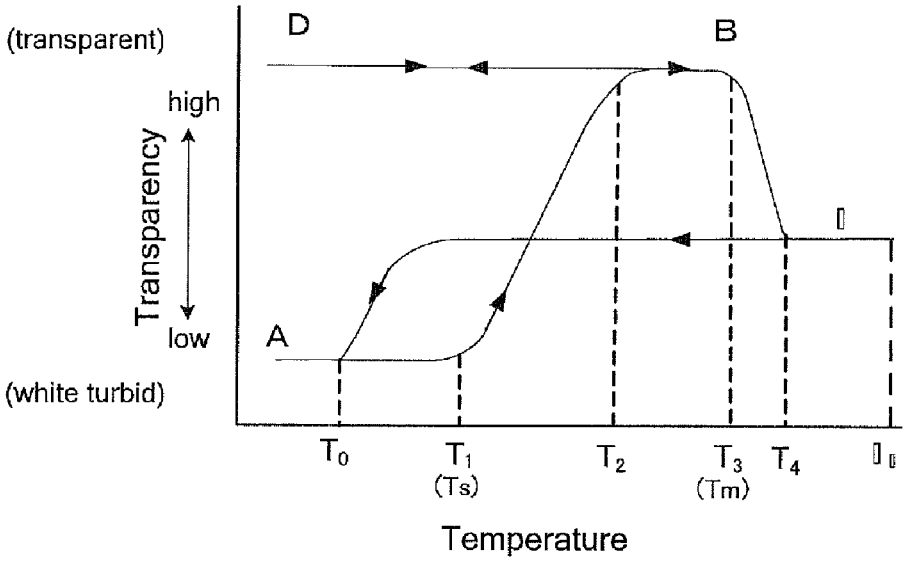
FIG. 7A is a graph showing the transparent and turbid properties of a thermoreversible recording medium.

First of all, an example of the temperature-transparency change curve of a thermoreversible recording medium having a thermoreversible recording layer (hereinafter otherwise referred to as "recording layer") formed by dispersing the low-molecular organic material in the resin is shown in FIG. 7A.

The recording layer is in a white turbid opaque state (A), for example, at normal temperature that is lower than or equal to the temperature $T_0$. Once the recording layer is heated, it gradually becomes transparent as the temperature exceeds the temperature $T_1$. When heated to a temperature between the temperatures $T_2$ and $T_3$, the recording layer becomes transparent (B). The recording layer remains transparent (D) even if the temperature is brought back to normal temperature that is lower than or equal to $T_0$. This is attributed to the following phenomena: when the temperature is in the vicinity of $T_1$, the resin starts to soften, then as the softening proceeds, the resin contracts, and voids at the interfaces between the resin and particles of the low-molecular organic material or voids inside these particles are reduced, so that the transparency gradually increases; at temperatures between $T_2$ and $T_3$, the low-molecular organic material comes into a semi-melted state, and the recording layer becomes transparent as remaining voids are filled with the low-molecular organic material; when the recording layer is cooled with seed crystals remaining, crystallization takes place at a fairly high temperature; at this time, since the resin is still in the softening state, the resin adapts to a volume change of the particles caused by the crystallization, the voids are not created, and the transparent state is maintained.

When further heated to a temperature higher than or equal to the temperature $T_4$, the recording layer comes into a semi-transparent state (C) that is between the maximum transparency and the maximum opacity. Next, when the temperature is lowered, the recording layer returns to the white turbid opaque state (A) it was in at the beginning, without coming into the transparent state again. It is inferred that this is because the low-molecular organic material completely melts at a temperature higher than or equal to T4, then comes into a supercooled state and crystallizes at a temperature a little higher than $T_0$, and on this occasion, the resin cannot adapt to a volume change of the particles caused by the crystallization, which leads to creation of voids.

Here, in FIG. 7A, when the temperature of the recording layer is repeatedly raised to the temperature $T_5$ far higher than $T_4$, there may be caused such an erasure failure that an image cannot be erased even if the recording layer is heated to an erasing temperature. This is attributed to a change in the internal structure of the recording layer caused by transfer of the low-molecular organic material, which has been melted by heating, in the resin. To reduce degradation of the thermoreversible recording medium caused by repeated use, it is necessary to decrease the difference between $T_4$ and $T_5$ in FIG. 7A when the thermoreversible recording medium is heated; in the case where a means of heating it is a laser beam, the ratio ($I_1/I_2$) in the intensity distribution of the laser beam is preferably 1.29 or less, and more preferably 1.25 or less.

As to the temperature-transparency change curve shown in FIG. 7A, it should be noted that when the type of the resin, the low-molecular organic material, etc. is changed, the transparency in the above-mentioned states may change depending upon the type.

Figure 7B:
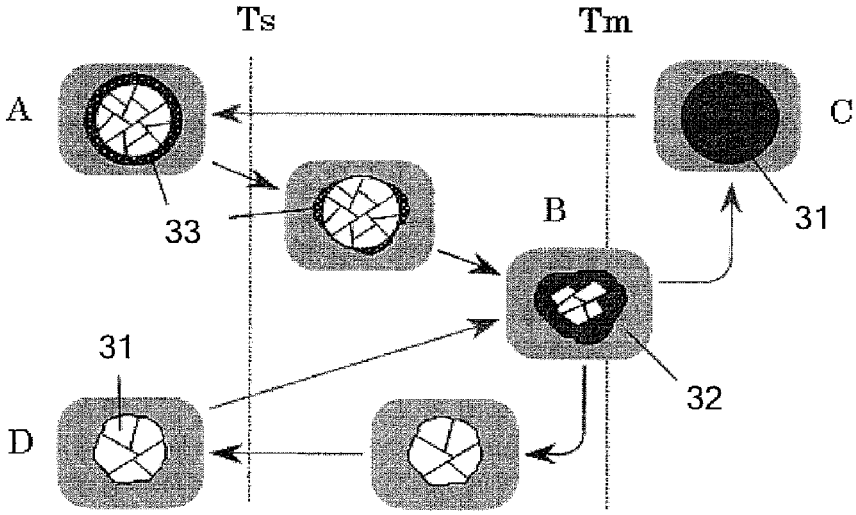
FIG. 7B is a schematic explanatory diagram showing a mechanism of the change of the thermoreversible recording medium between a transparent state and a turbid state.

FIG. 7B shows the mechanism of change in the transparency of the thermoreversible recording medium in which the transparent state and the white turbid state reversibly change by heat.

In FIG. 7B, one long-chain low-molecular material particle 31 and a polymer 32 around it are viewed, and changes related to creation and disappearance of a void 33, caused by heating and cooling, are shown. In a white turbid state (A), a void is created between the polymer and the low-molecular material particle (or inside the particle), and thus there is a state of light diffusion. When these are heated to a temperature higher than the softening temperature (Ts) of the polymer, the void decreases in size, and the transparency thereby increases. When these are further heated to a temperature close to the melting temperature (Tm) of the low-molecular material particle, a part of the low-molecular material particle melts; due to volume expansion of the low-molecular material particle that has melted, the void disappears as it is filled with the low-molecular material particle, and a transparent state (B) is thus produced. When cooling is carried out from this temperature, the low-molecular material particle crystallizes immediately below the melting temperature, a void is not created, and a transparent state (D) is maintained even at room temperature.

Subsequently, when heating is carried out such that the temperature becomes higher than or equal to the melting temperature of the low-molecular material particle, there is created a difference in refractive index between the low-molecular material particle that has melted and the polymer around it, and a semitransparent state (C) is thus produced. When cooling is carried out from this temperature to room temperature, the low-molecular material particle is supercooled and crystallizes at a temperature lower than or equal to the softening temperature of the polymer; at this time, the polymer around the low-molecular material particle is in a glassy state and therefore cannot adapt to a volume reduction of the low-molecular material particle caused by the crystallization; thus a void is created, and the white turbid state (A) is reproduced.

Next, in the aspect in which color tone reversibly changes depending upon temperature, the low-molecular organic material before melting is a leuco dye and a reversible developer (hereinafter otherwise referred to as "developer"), and the low-molecular organic material after melted and before crystallization is the leuco dye and the reversible developer and the color tone reversibly changes by heat between a transparent state and a color-developed state.

Figure 8A:
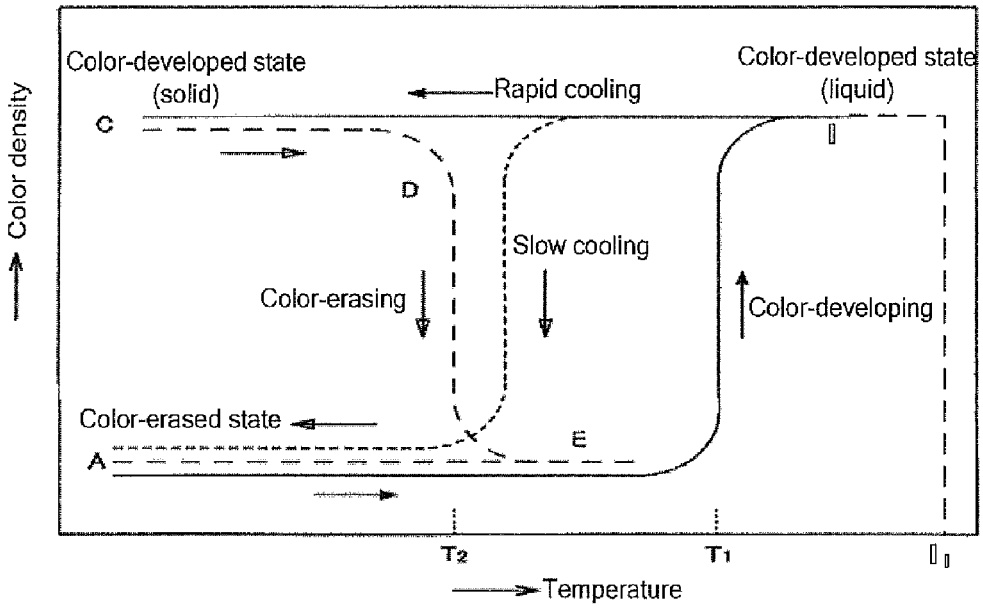
FIG. 8A is a graph showing the color-developing and color-erasing properties of a thermoreversible recording medium.
Figure 8B:
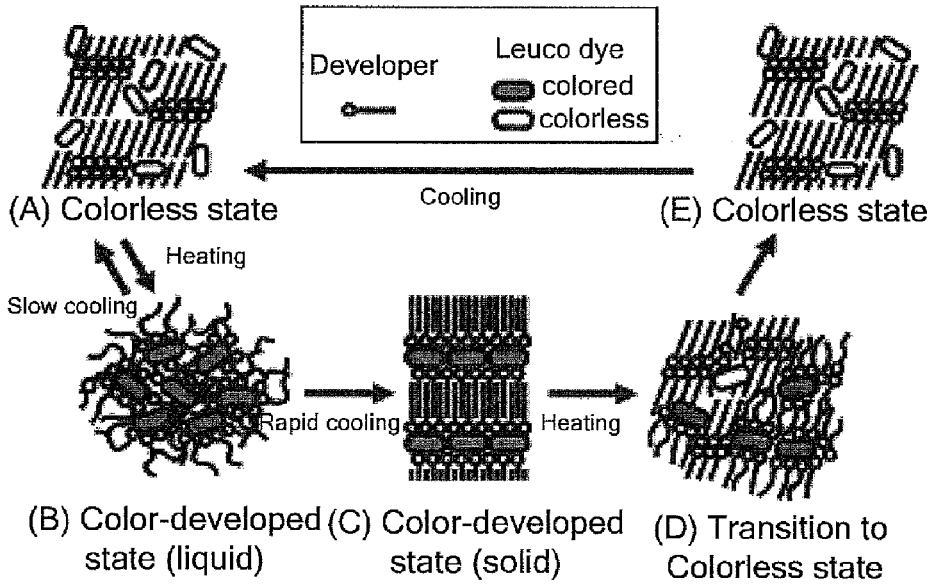
FIG. 8B is a schematic explanatory diagram showing a mechanism of color-developing and color-erasing of the thermoreversible recording medium.

FIG. 8A shows an example of the temperature-color-developing density change curve of a thermoreversible recording medium which has a thermoreversible recording layer formed of the resin containing the leuco dye and the developer. FIG. 8B shows the color-developing and color-erasing mechanism of the thermoreversible recording medium which reversibly changes by heat between a transparent state and a color-developed state.

First of all, when the recording layer in a colorless state (A) is raised in temperature, the leuco dye and the developer melt and mix at the melting temperature $T_1$, thereby developing color, and the recording layer thusly comes into a melted and color-developed state (B). When the recording layer in the melted and color-developed state (B) is rapidly cooled, the recording layer can be lowered in temperature to room temperature, with its color-developed state kept, and it thusly comes into a color-developed state (C) where its color-developed state is stabilized and fixed. Whether or not this color-developed state is obtained depends upon the temperature decreasing rate from the temperature in the melted state: in the case of slow cooling, the color is erased in the temperature decreasing process, and the recording layer returns to the colorless state (A) it was in at the beginning, or comes into a state where the density is low in comparison with the density in the color-developed state (C) produced by rapid cooling. When the recording layer in the color-developed state (C) is raised in temperature again, the color is erased at the temperature $T_2$ lower than the color-developing temperature (from D to E), and when the recording layer in this state is lowered in temperature, it returns to the colorless state (A) it was in at the beginning.

The color-developed state (C) obtained by rapidly cooling the recording layer in the melted state is a state where the leuco dye and the developer are mixed together such that their molecules can undergo contact reaction, which is often a solid state. This state is a state where a melted mixture (color-developing mixture) of the leuco dye and the developer crystallizes, and thus color development is maintained, and it is inferred that the color development is stabilized by the formation of this structure. Meanwhile, the colorless state is a state where the leuco dye and the developer are phase-separated. It is inferred that this state is a state where molecules of at least one of the compounds gather to constitute a domain or crystallize, and thus a stabilized state where the leuco dye and the developer are separated from each other by the occurrence of the flocculation or the crystallization. In many cases, phase separation of the leuco dye and the developer is brought about, and the developer crystallizes in this manner, thereby enabling color erasure with greater completeness.

As to both the color erasure by slow cooling from the melted state and the color erasure by temperature increase from the color-developed state shown in FIG. 8A, the aggregation structure changes at $T_2$, causing phase separation and crystallization of the developer.

Further, in FIG. 8A, when the temperature of the recording layer is repeatedly raised to the temperature $T_3$ higher than or equal to the melting temperature $T_1$, there may be caused such an erasure failure that an image cannot be erased even if the recording layer is heated to an erasing temperature. It is inferred that this is because the developer thermally decomposes and thus hardly flocculates or crystallizes, which makes it difficult for the developer to separate from the leuco dye. Degradation of the thermoreversible recording medium caused by repeated use can be reduced by decreasing the difference between the melting temperature $T_1$ and the temperature $T_3$ in FIG. 8A when the thermoreversible recording medium is heated.

[Thermoreversible Recording Medium]

The thermoreversible recording medium used in the image processing method of the present invention includes at least a support, a reversible thermosensitive recording layer and a photothermal conversion layer, and further includes other layers suitably selected in accordance with the necessity, such as an photothermal conversion layer, an ultraviolet absorbing layer, first and second oxygen barrier layers, a protective layer, an intermediate layer, an undercoat layer, a back layer, an adhesion layer, a tackiness layer, a colored layer, an air layer and a light-reflecting layer. Each of these layers may have a single-layer structure or a laminated structure.

—Support—

The shape, structure, size and the like of the support are suitably selected depending on the intended purpose without any restriction. Examples of the shape include plate-like shapes; the structure may be a single-layer structure or a laminated structure; and the size may be suitably selected according to the size of the thermoreversible recording medium, etc.

Examples of the material for the support include inorganic materials and organic materials.

Examples of the inorganic materials include glass, quartz, silicon, silicon oxide, aluminum oxide, $SiO_2$ and metals.

Examples of the organic materials include paper, cellulose derivatives such as cellulose triacetate, synthetic paper, and films made of polyethylene terephthalate, polycarbonates, polystyrene, polymethyl methacrylate, etc.

Each of the inorganic materials and the organic materials may be used alone or in combination with two or more. Among these materials, the organic materials are preferable, particularly films made of polyethylene terephthalate, polycarbonates, polymethyl methacrylate, etc. are preferable. Of these, polyethylene terephthalate is particularly preferable.

It is desirable that the support be subjected to surface modification by means of corona discharge, oxidation reaction (using chromic acid, for example), etching, facilitation of adhesion, antistatic treatment, etc. for the purpose of improving the adhesiveness of a coating layer.

Also, it is desirable to color the support white by adding, for example, a white pigment such as titanium oxide to the support.

The thickness of the support is suitably selected depending on the intended purpose without any restriction, with the range of 10 μm to 2,000 μm being preferable and the range of 50 μm to 1,000 μm being more preferable.

—Thermoreversible Recording Layer—

The thermoreversible recording layer (which may be hereinafter referred to simply as "recording layer") includes at least a material in which transparency or color tone reversibly changes depending upon temperature, and further includes other components in accordance with the necessity.

The material in which transparency or color tone reversibly changes depending upon temperature is a material capable of exhibiting a phenomenon in which visible changes are reversibly produced by temperature change; and the material can relatively change into a color-developed state and into a colorless state, depending upon the heating temperature and the cooling rate after heating. In this case, the visible changes can be classified into changes in the state of color and changes in shape. The changes in the state of color stem from changes in transmittance, reflectance, absorption wavelength, the degree of diffusion, etc., for example. The state of the color of the thermoreversible recording medium, in effect, changes due to a combination of these changes.

The material in which transparency or color tone reversibly changes depending upon temperature is suitably selected from known materials without any restriction. For example, two or more types of polymers are mixed and the color of the mixture becomes transparent or white turbid depending on compatibility (refer to JP-A 61-258853), a material taking advantage of phase change of a liquid crystal polymer (refer to JP-A 62-66990), a material which comes into a state of first color at a first specific temperature which is higher than normal temperature, and comes into a state of second color by heating at a second specific temperature which is higher than the first specific temperature, and then cooling.

Among the known materials, a material in which the color changes according to the first specific temperature and the second specific temperature is particularly preferable in that the temperature can be easily controlled and high contrast can be obtained.

Examples thereof include a material which comes into a transparent state at a first specific temperature and comes into a white turbid state at a second specific temperature (refer to JP-A No. 55-154198); a material which develops color at a second specific temperature and loses the color at a first specific temperature (refer to JP-A Nos. 04-224996, 04-247985 and 04-267190); a material which comes into a white turbid state at a first specific temperature and comes into a transparent state at a second specific temperature (refer to JP-A No. 03-169590); and a material which develops a color (black, red, blue, etc.) at a first specific temperature and loses the color at a second specific temperature (refer to JP-A Nos. 02-188293 and 02-188294).

Among these, a thermoreversible recording medium including a resin base material and a low-molecular organic material such as a higher fatty acid dispersed in the resin base material is advantageous in that a second specific temperature and a first specific temperature are relatively low, and so erasure and recording can be performed with low energy. Also, since the color-developing and color-erasing mechanism is a physical change which depends upon solidification of the resin and crystallization of the low-molecular organic material, the thermoreversible recording medium offers high environment resistance.

Additionally, a thermoreversible recording medium, which uses the after-mentioned leuco dye and reversible developer and which develops color at a second specific temperature and loses the color at a first specific temperature, exhibits a transparent state and a color-developed state reversibly and exhibits black, blue or other color in the color-developed state; therefore, a high-contrast image can be obtained.

The low-molecular organic material (which is dispersed in the resin base material and which comes into a transparent state at the first specific temperature and comes into a white turbid state at the second specific temperature) in the thermoreversible recording medium is suitably selected depending on the intended purpose without any restriction, provided that it can change from a polycrystalline material to a single-crystal material by heat in the recording layer. Generally, a material having a melting temperature of approximately 30° C. to 200° C. can be used therefor, preferably a material having a melting temperature of 50° C. to 150° C.

Such a low-molecular organic material is suitably selected depending on the intended purpose without any restriction. Examples thereof include alkanols; alkanediols; halogenated alkanols and halogenated alkanediols; alkylamines; alkanes; alkenes; alkines; halogenated alkanes; halogenated alkenes; halogenated alkines; cycloalkanes; cycloalkenes; cycloalkines; saturated or unsaturated monocarboxylic/dicarboxylic acids, esters thereof, amides thereof and ammonium salts thereof; saturated or unsaturated halogenated fatty acids, esters thereof, amides thereof and ammonium salts thereof; arylcarboxylic acids, esters thereof, amides thereof and ammonium salts thereof; halogenated arylcarboxylic acids, esters thereof, amides thereof and ammonium salts thereof; thioalcohols; thiocarboxylic acids, esters thereof, amines thereof and ammonium salts thereof; and carboxylic acid esters of thioalcohols. Each of these may be used alone or in combination with two or more.

Each of these compounds preferably has 10 to 60 carbon atoms, more preferably 10 to 38 carbon atoms, most preferably 10 to 30 carbon atoms. Alcohol groups in the esters may or may not be saturated, and may be halogen-substituted.

The low-molecular organic material preferably has in its molecules at least one selected from oxygen, nitrogen, sulfur and halogens, for example groups such as —OH, —COOH, —CONH—, —COOR, —NH—, —$NH_2$, —S—, —S—S— and —O—, and halogen atoms.

More specific examples of these compounds include higher fatty acids such as lauric acid, dodecanoic acid, myristic acid, pentadecanoic acid, palmitic acid, stearic acid, behenic acid, nonadecanoic acid, arachidonic acid and oleic acid; and esters of higher fatty acids such as methyl stearate, tetradecyl stearate, octadecyl stearate, octadecyl laurate, tetradecyl palmitate and dodecyl behenate. The low-molecular organic material used in the third aspect of the image processing method is preferably selected from higher fatty acids among these compounds, more preferably higher fatty acids having 16 or more carbon atoms such as palmitic acid, stearic acid, behenic acid and lignoceric acid, even more preferably higher fatty acids having 16 to 24 carbon atoms.

To increase the range of temperatures at which the thermoreversible recording medium can be made transparent, the above-mentioned low-molecular organic materials may be suitably combined together, or any of the above-mentioned low-molecular organic materials may be combined with other material having a different melting temperature. Use of such materials is disclosed in JP-A Nos. 63-39378 and 63-130380, JP-B No. 2615200 and so forth. It should, however, be noted that the use of such materials in the present invention is not confined thereto.

The resin base material forms a layer in which the low-molecular organic material is uniformly dispersed and held, and the resin base material affects the transparency when the thermoreversible recording medium becomes most transparent. For this reason, the resin base material is preferably a resin which is highly transparent, mechanically stable and excellent in film-forming property.

Such a resin is not particularly limited and may be suitably selected in accordance with the intended use. Examples thereof include polyvinyl chloride; vinyl chloride copolymers such as vinyl chloride-vinyl acetate copolymers, vinyl chloride-vinyl acetate-vinyl alcohol copolymers, vinyl chloride-vinyl acetate-maleic acid copolymers and vinyl chloride-acrylate copolymers; polyvinylidene chloride; vinylidene chloride copolymers such as vinylidene chloride-vinyl chloride copolymers and vinylidene chloride-acrylonitrile copolymers; polyesters; polyamides; polyacrylates, polymethacrylates and acrylate-methacrylate copolymers; and silicone resins. Each of these may be used alone or in combination with two or more.

The mass ratio of the low-molecular organic material to the resin (resin base material) in the recording layer is preferably in the range of approximately 2:1 to 1:16, more preferably in the range of approximately 1:2 to 1:8.

When the amount of the resin contained is so small as to be outside the mass ratio 2:1, it may be difficult to form a film in which the low-molecular organic material is held in the resin base material. When the amount of the resin contained is so large as to be outside the mass ratio 1:16, the amount of the low-molecular organic material is small, and thus it may be difficult to make the recording layer opaque.

Besides the low-molecular organic material and the resin, other components such as a high-boiling solvent and a surfactant may be added into the recording layer for the purpose of making it easier to record a transparent image.

The method for producing the recording layer is suitably selected depending on the intended purpose without any restriction. For instance, the recording layer can be produced as follows: a solution dissolving the resin base material and the low-molecular organic material, or a dispersion solution produced by dispersing the low-molecular organic material in the form of fine particles into a solution containing the resin base material (a solvent contained herein does not dissolve at least one selected from the above-mentioned low-molecular organic materials) is applied onto the support and dried.

The solvent used for producing the recording layer is suitably selected depending on the types of the resin base material and the low-molecular organic material without any restriction. Examples of the solvent include tetrahydrofuran, methyl ethyl ketone, methyl isobutyl ketone, chloroform, carbon tetrachloride, ethanol, toluene and benzene. When the solution is used, as well as when the dispersion solution is used, the low-molecular organic material is deposited in the form of fine particles and present in a dispersed state in the recording layer obtained.

Composed of the leuco dye and the reversible developer, the low-molecular organic material in the thermoreversible recoding medium may develop color at a second specific temperature and lose the color at a first specific temperature. The leuco dye is a dye precursor which is colorless or pale per se. The leuco dye is suitably selected from known leuco dyes without any restriction. Examples thereof include leuco compounds based upon triphenylmethane phthalide, triallylmethane, fluoran, phenothiazine, thiofluoran, xanthene, indophthalyl, spiropyran, azaphthalide, chromenopyrazole, methines, rhodamineanilinolactam, rhodaminelactam, quinazoline, diazaxanthene and bislactone. Among these, leuco dyes based upon fluoran and phthalide are particularly preferable in that they are excellent in color-developing and color-erasing property, colorfulness and storage ability. Each of these may be used alone or in combination with two or more, and the thermoreversible recording medium can be made suitable for multicolor or full-color recording by providing a layer which develops color with a different color tone.

The reversible developer is suitably selected depending on the intended purpose without any restriction, provided that it is capable of reversibly developing and erasing color by means of heat. Suitable examples thereof include a compound having in its molecules at least one of the following structures: a structure (1) having such a color-developing ability as makes the leuco dye develop color (for example, a phenolic hydroxyl group, a carboxylic acid group, a phosphoric acid group, etc.); and a structure (2) which controls cohesion among molecules (for example, a structure in which long-chain hydrocarbon groups are linked together). In the bonded site, the long-chain hydrocarbon group may be bonded via a divalent or more bond group containing a hetero atom. Additionally, the long-chain hydrocarbon groups may contain at least either similar linking groups or aromatic groups.

For the structure (1) having such a color-developing ability as makes the leuco dye develop color, phenol is particularly suitable.

For the structure (2) which controls cohesion among molecules, long-chain hydrocarbon groups having 8 or more carbon atoms, preferably 11 or more carbon atoms, are suitable, and the upper limit of the number of carbon atoms is preferably 40 or less, more preferably 30 or less.

Among the reversible developers, phenolic compounds represented by General Formula (1) are desirable, and phenolic compounds represented by General Formula (2) are more desirable.

General Formula (1)

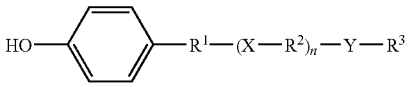

General Formula (2)

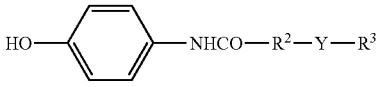

In General Formulae (1) and (2), $R^1$ denotes a single bond or an aliphatic hydrocarbon group having 1 to 24 carbon atoms. $R^2$ denotes an aliphatic hydrocarbon group having two or more carbon atoms, which may have a substituent, and the number of the carbon atoms is preferably 5 or greater, more preferably 10 or greater. $R^3$ denotes an aliphatic hydrocarbon group having 1 to 35 carbon atoms, and the number of the carbon atoms is preferably 6 to 35, more preferably 8 to 35. Each of these aliphatic hydrocarbon groups may be provided alone or in combination with two or more.

The sum of the numbers of carbon atoms which $R^1$, $R^2$ and $R^3$ have is suitably selected depending on the intended purpose without any restriction, with its lower limit being preferably 8 or greater, more preferably 11 or greater, and its upper limit being preferably 40 or less, more preferably 35 or less.

When the sum of the numbers of carbon atoms is less than 8, color-developing stability or color-erasing ability may degrade.

Each of the aliphatic hydrocarbon groups may be a straight-chain group or a branched-chain group and may have an unsaturated bond, with preference being given to a straight-chain group. Examples of the substituent bonded to the aliphatic hydrocarbon group include hydroxyl group, halogen atoms and alkoxy groups.

X and Y may be identical or different, each denoting an N atom-containing or O atom-containing divalent group. Specific examples thereof include oxygen atom, amide group, urea group, diacylhydrazine group, diamide oxalate group and acylurea group, with amide group and urea group being preferable.

"n" denotes an integer of 0 to 1.

It is desirable that the electron-accepting compound (developer) be used together with a compound as a color erasure accelerator having in its molecules at least one of —NHCO— group and —OCONH— group because intermolecular interaction is induced between the color erasure accelerator and the developer in a process of producing a colorless state and thus there is an improvement in color-developing and color-erasing property.

The color erasure accelerator is suitably selected depending on the intended purpose without any restriction.

For the reversible thermosensitive recording layer, a binder resin and, if necessary, additives for improving or controlling the coating properties and color-developing and color-erasing properties of the recording layer may be used. Examples of these additives include a surfactant, a conductive agent, a filling agent, an antioxidant, a light stabilizer, a color development stabilizer and a color erasure accelerator.

The binder resin is suitably selected depending on the intended purpose without any restriction, provided that it enables the recording layer to be bonded onto the support. For instance, one of conventionally known resins or a combination of two or more thereof may be used for the binder resin. Among these resins, resins capable of being cured by heat, an ultraviolet ray, an electron beam or the like are preferable in that the durability at the time of repeated use can be improved, with particular preference being given to thermosetting resins each containing an isocyanate-based compound or the like as a cross-linking agent. Examples of the thermosetting resins include a resin having a group which reacts with a cross-linking agent, such as a hydroxyl group or carboxyl group, and a resin produced by copolymerizing a hydroxyl group-containing or carboxyl group-containing monomer and other monomer. Specific examples of such thermosetting resins include phenoxy resins, polyvinyl butyral resins, cellulose acetate propionate resins, cellulose acetate butyrate resins, acrylpolyol resins, polyester polyol resins and polyurethane polyol resins, with particular preference being given to acrylpolyol resins, polyester polyol resins and polyurethane polyol resins.

The mixture ratio (mass ratio) of the color developer to the binder resin in the recording layer is preferably in the range of 1:0.1 to 1:10. When the amount of the binder resin is too small, the recording layer may be deficient in thermal strength. When the amount of the binder resin is too large, it is problematic because the color-developing density decreases.

The cross-linking agent is suitably selected depending on the intended purpose without any restriction, and examples thereof include isocyanates, amino resins, phenol resins, amines and epoxy compounds. Among these, isocyanates are preferable, and polyisocyanate compounds each having a plurality of isocyanate groups are particularly preferable.

As to the amount of the cross-linking agent added in relation to the amount of the binder resin, the ratio of the number of functional groups contained in the cross-linking agent to the number of active groups contained in the binder resin is preferably in the range of 0.01:1 to 2:1. When the amount of the cross-linking agent added is so small as to be outside this range, sufficient thermal strength cannot be obtained. When the amount of the cross-linking agent added is so large as to be outside this range, there is an adverse effect on the color-developing and color-erasing properties.

Further, as a cross-linking promoter, a catalyst utilized in this kind of reaction may be used.

The gel fraction of any of the thermosetting resins in the case where thermally cross-linked is preferably 30% or greater, more preferably 50% or greater, even more preferably 70% or greater. When the gel fraction is less than 30%, an adequate cross-linked state cannot be produced, and thus there may be degradation of durability.

As to a method for distinguishing between a cross-linked state and a non-cross-linked state of the binder resin, these two states can be distinguished by immersing a coating film in a solvent having high dissolving ability, for example. Specifically, with respect to the binder resin in a non-cross-linked state, the resin dissolves in the solvent and thus does not remain in a solute.

The above-mentioned other components in the recording layer are suitably selected depending on the intended purpose without any restriction. For instance, a surfactant, a plasticizer and the like are suitable therefor in that recording of an image can be facilitated.

To a solvent, a coating solution dispersing device, a recording layer applying method, a drying and hardening method and the like used for the recording layer coating solution, those that are known can be applied. To prepare the recording layer coating solution, materials may be together dispersed into a solvent using the dispersing device; alternatively, the materials may be independently dispersed into respective solvents and then the solutions may be is mixed together. Further, the ingredients may be heated and dissolved, and then they may be precipitated by rapid cooling or slow cooling.

The method for forming the recording layer is suitably selected depending on the intended purpose without any restriction. Suitable examples thereof include a method (1) of applying onto a support a recording layer coating solution in which the resin, the electron-donating color-forming compound and the electron-accepting compound are dissolved or dispersed in a solvent, then cross-linking the coating solution while or after forming it into a sheet or the like by evaporation of the solvent; a method (2) of applying onto a support a recording layer coating solution in which the electron-donating color-forming compound and the electron-accepting compound are dispersed in a solvent dissolving only the resin, then cross-linking the coating solution while or after forming it into a sheet or the like by evaporation of the solvent; and a method (3) of not using a solvent and heating and melting the resin, the electron-donating color-forming compound and the electron-accepting compound so as to mix, then cross-linking this melted mixture after forming it into a sheet or the like and cooling it. In each of these methods, it is also possible to produce the recording layer as a thermoreversible recording medium in the form of a sheet, without using the support.

The solvent used in (1) or (2) cannot be unequivocally defined, as it is affected by the types, etc. of the resin, the electron-donating color-forming compound and the electron-accepting compound. Examples thereof include tetrahydrofuran, methyl ethyl ketone, methyl isobutyl ketone, chloroform, carbon tetrachloride, ethanol, toluene and benzene.

Additionally, the electron-accepting compound is present in the recording layer, being dispersed in the form of particles.

Pigments, an antifoaming agent, a dispersant, a slip agent, an antiseptic agent, a cross-linking agent, a plasticizer and the like may be added into the recording layer coating solution, for the purpose of exhibiting high performance as a coating material.

The coating method for the recording layer is suitably selected depending on the intended purpose without any restriction. For instance, a support which is continuous in the form of a roll or which has been cut into the form of a sheet is conveyed, and the support is coated with the recording layer by a known method such as blade coating, wire bar coating, spray coating, air knife coating, bead coating, curtain coating, gravure coating, kiss coating, reverse roll coating, dip coating or die coating.

The drying conditions of the recording layer coating solution are suitably selected depending on the intended purpose without any restriction. For instance, the recording layer coating solution is dried at room temperature (25° C.) to a temperature of 140° C., for approximately 10 sec to 10 min.

The thickness of the recording layer is suitably selected depending on the intended purpose without any restriction. For instance, it is preferably 1 μm to 20 μm, more preferably 3 μm to 15 μm. When the recording layer is too thin, the contrast of an image may lower because the color-developing density lowers. When the recording layer is too thick, the heat distribution in the layer increases, a portion which does not reach a color-developing temperature and so does not develop color is created, and thus a desired color-developing density may be unable to be obtained.

—Photothermal Conversion Layer—

The photothermal conversion layer is a layer having a function to absorb laser beams and generate heat.

The photothermal conversion layer at least contains a photothermal conversion material having a function to absorb the laser beam at high efficiency and then generate heat. It is particularly preferable that the photothermal conversion material is contained in the thermoreversible recording layer, or at least one of the adjacent layers of the thermoreversible recording layer. In the case where the photothermal conversion material is contained in the thermoreversible recording layer, the thermoreversible recording layer also functions as a photothermal conversion layer. In the case where the photothermal conversion material is contained in at least one of the adjacent layers of the thermoreversible recording layer, by covering the layer containing the photothermal conversion material with the thermoreversible recording layer, the heat generated in the photothermal conversion layer can be efficiently used, and lowering of recording and erasing sensitivities due to the layer separation can be suppressed. Here, the thermoreversible recording layer and the photothermal conversion layer being adjacently disposed means that the photothermal conversion layer is disposed so as to be in contact with the thermoreversible recording layer, or the photothermal conversion layer is disposed on the thermoreversible recording layer via a layer having a thickness thinner than the thickness of the thermoreversible recording layer. There is a case where a barrier layer is formed between the thermoreversible recording layer and the photothermal conversion layer so as to suppress the interaction between them. Such barrier layer is preferably a layer having high heat conductivity in terms of a material used therein. The layer formed between the thermoreversible recording layer and the photothermal conversion layer is suitably selected depending on the intended purpose, and is not necessarily limited to the example mentioned above.

The photothermal conversion material is broadly classified into inorganic materials and organic materials.

Examples of the inorganic materials include carbon black, metals such as Ge, Bi, In, Te, Se, and Cr, or semi-metals thereof or alloys thereof. Each of these inorganic materials is formed into a layer form by vacuum evaporation method or by bonding a particulate material to a layer surface using a resin or the like.

For the organic material, various dyes can be suitably used in accordance with the wavelength of light to be absorbed, however, when a semiconductor laser is used as a light source, a near-infrared absorption pigment having an absorption peak near wavelengths of 700 nm to 1,500 nm. Specific examples thereof include cyanine pigments, quinone pigments, quinoline derivatives of indonaphthol, phenylene diamine-based nickel complexes, phthalocyanine compounds, and naphthalocyanine compounds. To secure durability against repeated recording and erasure of an image, it is preferable to select a photothermal conversion material that is excellent in heat resistance.

Each of the near-infrared absorption pigments may be used alone or in combination with two or more.

When the photothermal conversion layer is formed, the photothermal conversion material is typically used in combination with a resin. The resin used in the photothermal conversion layer is suitably selected from among those known in the art without any restriction, provided that it can maintain the inorganic material and the organic material therein, however, thermoplastic resins and thermosetting resins are preferable, and those similar to the binder resin used in the recording layer can be suitably used. Among them, resins curable with the application of heat, ultraviolet light, or an electron beam can be preferably used for improving the durability against the repetitive use, and a thermal crosslinkable resin using an isocyanate compound is particularly preferable. The binder resin preferably has a hydroxyl value of 100 mgKOH/g to 400 mgKOH/g.

The thickness of the photothermal conversion layer is suitably selected depending on the intended purpose without any restriction, but is preferably 1 μm to 20 μm.

—Ultraviolet Absorbing Layer—

In the present invention, an ultraviolet absorbing layer is preferably disposed on the thermoreversible recording layer for preventing residual images from erasure due to coloring of the leuco dye contained in the thermoreversible recording layer by ultraviolet light and photodeterioration thereof. With ultraviolet absorbing layer, the light resistance of the recording medium is improved. The light resistance of the recording medium can be significantly improved by appropriately adjusting the thickness of the ultraviolet absorbing layer so as to absorb ultraviolet light having a wavelength of 390 nm or shorter.

The ultraviolet absorbing layer at least contains a binder resin and an ultraviolet absorber, and may further contain other components such as filler, lubricants, color pigments and the like, if necessary.

The binder resin is suitably selected depending on the intended purpose without any restriction. The binder resin used in the thermoreversible recording layer, or resinous substances such as thermoplastic resins and thermosetting resins can be used as the binder resin. Examples of the resinous substances include polyethylene, polypropylene, polystyrene, polyvinyl alcohol, polyvinyl butyral, polyurethane, saturated polyester, unsaturated polyester, epoxy resin, phenol resin, polycarbonate, and polyamide.

The ultraviolet absorber can be of an organic compound or an inorganic compound.

Moreover, it is preferable to use a polymer having an ultraviolet absorbing structure (hereinafter, may be referred as "ultraviolet absorbing polymer"), as the ultraviolet absorber.

Here, the polymer having the ultraviolet absorbing structure means a polymer having an ultraviolet absorbing structure (e.g. an ultraviolet absorbing group) in the molecule thereof. Examples of the ultraviolet absorbing structure include a salicylate structure, a cyanoacrylate structure, a benzotriazol structure, and a benzophenone structure. Among them, the benzotriazol structure and the benzophenone structure are particularly preferable as they absorb the ultraviolet light having a wavelength of 340 nm to 400 nm which is a factor to cause a photodeterioration of the leuco dye.

The ultraviolet absorbing polymer is preferably crosslinked. Accordingly, it is preferable that those having a group reactive to a setting agent, such as a hydroxyl group, amino group and carboxyl group, are used as the ultraviolet absorbing polymer, and the polymer having a hydroxyl group is particularly preferable. In order to increase a physical strength of the layer containing the polymer having the ultraviolet absorbing structure, use of the polymer having a hydroxyl value of 10 mgKOH/g or more provides a sufficient coating film strength, more preferably 30 mgKOH/g or more, yet more preferably 40 mgKOH/g or more. By giving the sufficient coating film strength, the deterioration of the recording medium can be suppressed even after erasing and printing are repetitively performed.

The thickness of the ultraviolet absorbing layer is preferably 0.1 μm to 30 μm, more preferably 0.5 μm to 20 μm. For a solvent used for a coating liquid of the ultraviolet absorbing layer, a dispersing device for the coating liquid, a coating method of the ultraviolet absorbing layer, a drying and curing method of the ultraviolet absorbing layer and the like, the conventional methods used for the thermoreversible recording layer can be used.

—First and Second Oxygen Barrier Layers—

It is preferable that the first and second oxygen barrier layers are disposed on and under the thermoreversible recording layer, respectively so as to prevent the oxygen from entering the thermoreversible recording medium to thereby prevent the photodeterioration of the leuco dye contained in the first and second thermoreversible recording layers. Namely, it is preferable that the first oxygen barrier layer is disposed between the support and the thermoreversible recording layer, and the second oxygen barrier layer is disposed on the thermoreversible recording layer.

Examples of the first and second oxygen barrier layers include resin or polymer films having a large transmittance with visible light and low oxygen permeation. The oxygen barrier layer is selected depending on the use thereof, oxygen permeation, transparency, easiness of coating, adhesiveness, and the like. Specific examples of the oxygen barrier layer include a silica deposited film, an alumina deposited film, and a silica-alumina deposited film in all of which inorganic oxide is vapor deposited on a resin or polymer film. Here, examples of the resin include polyalkyl acrylate, polyalkyl methacrylate, polymethachloronitrile, polyalkylvinyl ester, polyalkylvinyl ether, polyvinyl fluoride, polystyrene, acetic acid-vinyl copolymer, cellulose acetate, polyvinyl alcohol, polyvinylidene chloride, acetonitrile copolymer, vinylidene chloride copolymer, poly(chlorotrifluoroethylene), ethylene-vinyl alcohol copolymer, polyacrylonitrile, acrylonitrile copolymer, polyethylene terephthalate, nylon-6, and polyacetal, and examples of the polymer include polyethylene terephthalate and nylon. Among then the film in which the inorganic oxide is deposited on the polymer film is preferable.

The oxygen permeation rate of the oxygen barrier layer is preferably 20 mL/m$^2$/day/MPa or less, more preferably 5 mL/m$^2$/day/MPa or less, yet more preferably 1 mL/m$^2$/day/MPa or less. When the oxygen permeation rate thereof is more than 20 mL/m$^2$/day/MPa or less, the photodeterioration of the leuco dye contained in the thermoreversible recording layer may not be prevented.

The oxygen permeation rate can be measured, for example, by the measuring method in accordance with JIS K7126 B.

The oxygen barrier layer can be disposed so as to sandwich the thermoreversible recording layer, such as disposing under the thermoreversible recording layer or on the back surface of the support. By disposing the oxygen barrier layer in this manner, the oxygen is efficiently prevented from entering the thermoreversible recording medium, and thus the photodeterioration of the leuco dye can be suppressed.

The method for forming the oxygen barrier layer is suitably selected depending on the indented purpose without any restriction. Examples thereof include melt extrusion, coating, laminating, and the like.

The thickness of each of the first and second oxygen barrier layers varies depending on the oxygen permeation rate of the resin or polymer film, but is preferably 0.1 μm to 100 μm. When the thickness thereof is less than 0.1 μm, oxygen barrier properties are insufficient. When the thickness thereof is more than 100 μm, it is not preferable as the transparency thereof is lowered.

An adhesive layer may be disposed between the oxygen barrier layer and the underlying layer. The method for forming the adhesive layer is not particularly limited, and examples thereof include coating, laminating, and the like. The thickness of the adhesive layer is not particularly limited, but is preferably 0.1 μm to 5 μm. The adhesive layer may be cured with a crosslinking agent. As the crosslinking agent, those used in the thermoreversible recording layer can be suitably used.

—Protective Layer—

In the thermoreversible recording medium of the present invention, it is desirable that a protective layer be provided on the recording layer, for the purpose of protecting the recording layer. The protective layer is suitably selected depending on the intended purpose without any restriction. For instance, the protective layer may be formed from one or more layers, and it is preferably provided on the outermost surface that is exposed.

The protective layer contains a binder resin and further contains other components such as a filler, a lubricant and a coloring pigment in accordance with the necessity.

The resin in the protective layer is suitably selected depending on the intended purpose without any restriction. For instance, the resin is preferably a thermosetting resin, an ultraviolet (UV) curable resin, an electron beam curable resin, etc., with particular preference being given to an ultraviolet (UV) curable resin and a thermosetting resin.

The UV-curable resin is capable of forming a very hard film after cured, and reducing damage done by physical contact of the surface and deformation of the medium caused by laser heating; therefore, it is possible to obtain a thermoreversible recording medium superior in durability against repeated use. Although slightly inferior to the UV-curable resin, the thermosetting resin makes it possible to harden the surface as well and is superior in durability against repeated use.

The UV-curable resin is suitably selected from known UV-curable resins in accordance with the intended use without any restriction. Examples thereof include oligomers based upon urethane acrylates, epoxy acrylates, polyester acrylates, polyether acrylates, vinyls and unsaturated polyesters; and monomers such as monofunctional and multifunctional acrylates, methacrylates, vinyl esters, ethylene derivatives and allyl compounds. Among these, multifunctional, i.e. tetrafunctional or higher, monomers and oligomers are particularly preferable. By mixing two or more of these monomers or oligomers, it is possible to suitably adjust the hardness, degree of contraction, flexibility, coating strength, etc. of the resin film.

To cure the monomers and the oligomers with an ultraviolet ray, it is necessary to use a photopolymerization initiator or a photopolymerization accelerator. The amount of the photopolymerization initiator or the photopolymerization accelerator added is preferably 0.1% by mass to 20% by mass, more preferably 1% by mass to 10% by mass, in relation to the total mass of the resin component of the protective layer.

Ultraviolet irradiation for curing the ultraviolet curable resin can be conducted using a known ultraviolet irradiator, and examples of the ultraviolet irradiator include one equipped with a light source, lamp fittings, a power source, a cooling device, a conveyance device, etc.

Examples of the light source include a mercury-vapor lamp, a metal halide lamp, a potassium lamp, a mercury-xenon lamp and a flash lamp. The wavelength of the light source may be suitably selected according to the ultraviolet absorption wavelength of the photopolymerization initiator and the photopolymerization accelerator added to the thermoreversible recording medium composition.

The conditions of the ultraviolet irradiation are suitably selected in accordance with the intended use without any restriction. For instance, it is advisable to decide the lamp output, the conveyance speed, etc. according to the irradiation energy necessary to cross-link the resin.

In order to improve the conveyance capability, a releasing agent such as a silicone having a polymerizable group, a silicone-grafted polymer, wax or zinc stearate; or a lubricant such as silicone oil may be added. The amount of any of these added is preferably 0.01% by mass to 50% by mass, more preferably 0.1% by mass to 40% by mass, in relation to the total mass of the resin component of the protective layer. Each of these may be used alone or in combination with two or more. Additionally, in order to prevent static electricity, a conductive filler is preferably used, more preferably a needle-like conductive filler.

The particle diameter of the inorganic pigment is preferably 0.01 μm to 10.0 μm, more preferably 0.05 μm to 8.0 μm. The amount of the inorganic pigment added is preferably 0.001 parts by mass to 2 parts by mass, more preferably 0.005 parts by mass to 1 part by mass, in relation to 1 part by mass of the heat-resistant resin.

Further, a surfactant, a leveling agent, an antistatic agent and the like that are conventionally known may be contained in the protective layer as additives.

Also, as the thermosetting resin, a resin similar to the binder resin used for the recording layer can be suitably used, for instance.

A polymer having an ultraviolet absorbing structure (hereinafter otherwise referred to as "ultraviolet absorbing polymer") may also be used.

Here, the polymer having an ultraviolet absorbing structure denotes a polymer having an ultraviolet absorbing structure (e.g. ultraviolet absorbing group) in its molecules. Examples of the ultraviolet absorbing structure include salicylate structure, cyanoacrylate structure, benzotriazole structure and benzophenone structure. Among these, benzotriazole structure and benzophenone structure are particularly preferable for their superior light resistance.

It is desirable that the thermosetting resin be cross-linked. Accordingly, the thermosetting resin is preferably a resin having a group which reacts with a curing agent, such as hydroxyl group, amino group or carboxyl group, particularly preferably a hydroxyl group-containing polymer. To increase the strength of a layer which contains the polymer having an ultraviolet absorbing structure, use of the polymer having a hydroxyl value of 10 mgKOH/g or greater is preferable because adequate coating strength can be obtained, more preferably use of the polymer having a hydroxyl value of 30 mgKOH/g or greater, even more preferably use of the polymer having a hydroxyl value of 40 mgKOH/g or greater. By making the protective layer have adequate coating strength, it is possible to reduce degradation of the recording medium even when erasure and printing are repeatedly carried out.

As the curing agent, a curing agent similar to the one used for the recording layer can be suitably used.

To a solvent, a coating solution dispersing device, a protective layer applying method, a drying method and the like used for the protective layer coating solution, those that are known and used for the recording layer can be applied. When an ultraviolet curable resin is used, a curing step by means of the ultraviolet irradiation with which coating and drying have been carried out is required, in which case an ultraviolet irradiator, a light source and the irradiation conditions are as described above.

The thickness of the protective layer is preferably 0.1 μm to 20 μm, more preferably 0.5 μm to 10 μm, even more preferably 1.5 μm to 6 μm. When the thickness is less than 0.1 μm, the protective layer cannot fully perform the function as a protective layer of a thermoreversible recording medium, the thermoreversible recording medium easily degrades through repeated use with heat, and thus it may become unable to be repeatedly used. When the thickness is greater than 20 μm, it is impossible to pass adequate heat to a thermosensitive section situated under the protective layer, and thus printing and erasure of an image by heat may become unable to be sufficiently performed.

—Intermediate Layer—

In the present invention, it is desirable to provide an intermediate layer between the recording layer and the protective layer, for the purpose of improving adhesiveness between the recording layer and the protective layer, preventing change in the quality of the recording layer caused by application of the protective layer, and preventing the additives in the protective layer from transferring to the recording layer. This makes it possible to improve the ability to store a color-developing image.

The intermediate layer contains at least a binder resin and further contains other components such as a filler, a lubricant and a coloring pigment in accordance with the necessity.

The binder resin is suitably selected depending on the intended purpose without any restriction. For the binder resin, the binder resin used for the recording layer or a resin component such as a thermoplastic resin or thermosetting resin may be used. Examples of the resin component include polyethylene, polypropylene, polystyrene, polyvinyl alcohol, polyvinyl butyral, polyurethane, saturated polyesters, unsaturated polyesters, epoxy resins, phenol resins, polycarbonates and polyamides.

It is desirable that the intermediate layer contain an ultraviolet absorber. For the ultraviolet absorber, any one of an organic compound and an inorganic compound may be used.

Also, an ultraviolet absorbing polymer may be used, and this may be cured by means of a cross-linking agent. As these compounds, compounds similar to those used for the protective layer can be suitably used.

The thickness of the intermediate layer is preferably 0.1 μm to 20 μm, more preferably 0.5 μm to 5 μm. To a solvent, a coating solution dispersing device, an intermediate layer applying method, an intermediate layer drying and hardening method and the like used for the intermediate layer coating solution, those that are known and used for the recording layer can be applied.

—Under Layer—

In the present invention, an under layer may be provided between the recording layer and the support, for the purpose of effectively utilizing applied heat for high sensitivity, or improving adhesiveness between the support and the recording layer, and preventing permeation of recording layer materials into the support.

The under layer contains at least hollow particles, also contains a binder resin and further contains other components in accordance with the necessity.

Examples of the hollow particles include single hollow particles in which only one hollow portion is present in each particle, and multi hollow particles in which numerous hollow portions are present in each particle. These types of hollow particles may be used independently or in combination.

The material for the hollow particles is suitably selected depending on the intended purpose without any restriction, and suitable examples thereof include thermoplastic resins. For the hollow particles, suitably produced hollow particles may be used, or a commercially available product may be used. Examples of the commercially available product include MICROSPHERE R-300 (manufactured by Matsumoto Yushi-Seiyaku Co., Ltd.); ROPAQUE HP1055 and ROPAQUE HP433J (both of which are manufactured by Zeon Corporation); and SX866 (manufactured by JSR Corporation).

The amount of the hollow particles added into the under layer is suitably selected depending on the intended purpose without any restriction, and it is preferably 10% by mass to 80% by mass, for instance.

For the binder resin, a resin similar to the resin used for the recording layer or used for the layer which contains the polymer having an ultraviolet absorbing structure can be used.

The under layer may contain at least one of an organic filler and an inorganic filler such as calcium carbonate, magnesium carbonate, titanium oxide, silicon oxide, aluminum hydroxide, kaolin or talc.

Besides, the under layer may contain a lubricant, a surfactant, a dispersant and so forth.

The thickness of the under layer is suitably selected depending on the intended purpose without any restriction, with the range of 0.1 μm to 50 μm being desirable, the range of 2 μm to 30 μm being more desirable, and the range of 12 μm to 24 μm being even more desirable.

—Back Layer—

In the present invention, for the purpose of preventing curl and static charge on the thermoreversible recording medium and improving the conveyance capability, a back layer may be provided on the side of the support opposite to the surface where the recording layer is formed.

The back layer contains at least a binder resin and further contains other components such as a filler, a conductive filler, a lubricant and a coloring pigment in accordance with the necessity.

The binder resin is suitably selected depending on the intended purpose without any restriction. For instance, the binder resin is any one of a thermosetting resin, an ultraviolet (UV) curable resin, an electron beam curable resin, etc., with particular preference being given to an ultraviolet (UV) curable resin and a thermosetting resin.

For the ultraviolet curable resin, the thermosetting resin, the filler, the conductive filler and the lubricant, ones similar to those used for the recording layer, the protective layer or the intermediate layer can be suitably used.

—Adhesion Layer or Tackiness Layer—

In the present invention, the thermoreversible recording medium can be produced as a thermoreversible recording label by providing an adhesion layer or a tackiness layer on the surface of the support opposite to the surface where the recording layer is formed. The material for the adhesion layer or the tackiness layer can be selected from commonly used materials.

The material for the adhesion layer or the tackiness layer is suitably selected depending on the intended purpose without any restriction. Examples thereof include urea resins, melamine resins, phenol resins, epoxy resins, vinyl acetate resins, vinyl acetate-acrylic copolymers, ethylene-vinyl acetate copolymers, acrylic resins, polyvinyl ether resins, vinyl chloride-vinyl acetate copolymers, polystyrene resins, polyester resins, polyurethane resins, polyamide resins, chlorinated polyolefin resins, polyvinyl butyral resins, acrylic acid ester copolymers, methacrylic acid ester copolymers, natural rubbers, cyanoacrylate resins and silicone resins.

The material for the adhesion layer or the tackiness layer may be of a hot-melt type. Release paper may or may not be used.

In the thermoreversible recording medium, a colored layer may be provided between the support and the recording layer, for the purpose of improving visibility. The colored layer can be formed by applying a dispersion solution or a solution containing a colorant and a resin binder over a target surface and drying the dispersion solution or the solution; alternatively, the colored layer can be formed by simply bonding a colored sheet to the target surface.

The thermoreversible recording medium may be provided with a color printing layer. A colorant in the color printing layer is, for example, selected from dyes, pigments and the like contained in color inks used for conventional full-color printing. Examples of the resin binder include thermoplastic resins, thermosetting resins, ultraviolet curable resins and electron beam curable resins. The thickness of the color printing layer may be suitably selected according to the desired printed color density.

In the thermoreversible recording medium, an irreversible recording layer may be additionally used. In this case, the color-developing color tones of the recording layers may be identical or different. Also, a colored layer which has been printed in accordance with offset printing, gravure printing, etc. or which has been printed with a pictorial design or the like using an ink-jet printer, a thermal transfer printer, a sublimation printer, etc., for example, may be provided on the whole or a part of the same surface of the thermoreversible recording medium of the present invention as the surface where the recording layer is formed, or may be provided on a part of the opposite surface thereof. Further, an OP varnish layer composed mainly of a curable resin may be provided on a part or the whole surface of the colored layer. Examples of the pictorial design include letters/characters, patterns, diagrams, photographs, and information detected with an infrared ray. Also, any of the layers that are simply formed may be colored by addition of dye or pigment.

Further, the thermoreversible recording medium of the present invention may be provided with a hologram for security. Also, to give variety in design, it may also be provided with a design such as a portrait, a company emblem or a symbol by forming depressions and protrusions in relief or in intaglio.

The thermoreversible recording medium may be formed into a desired shape according to its use, for example into a card, a tag, a label, a sheet or a roll. The thermoreversible recording medium in the form of a card can be used for prepaid cards, discount cards, credit cards and the like. The thermoreversible recording medium in the form of a tag that is smaller in size than the card can be used for price tags and the like. The thermoreversible recording medium in the form of a tag that is larger in size than the card can be used for tickets, sheets of instruction for process control and shipping, and the like. The thermoreversible recording medium in the form of a label can be affixed; accordingly, it can be formed into a variety of sizes and, for example, used for process control and product control, being affixed to carts, receptacles, boxes, containers, etc. to be repeatedly used. The thermoreversible recording medium in the form of a sheet that is larger in size than the card offers a larger area for printing, and thus it can be used for general documents and sheets of instruction for process control, for example.

<Example of Combination of Thermoreversible Recording Member and RF-ID>

A thermoreversible recording member used in the present invention is superior in convenience because the recording layer capable of reversible display, and an information storage section are provided on the same card or tag (so as to form a single unit), and part of information stored in the information storage section is displayed on the recording layer, thereby making it is possible to confirm the information by simply looking at a card or a tag without needing a special device. Also, when information stored in the information storage section is rewritten, rewriting of information displayed by the thermoreversible recording member makes it possible to use the thermoreversible recording medium repeatedly as many times as desired.

The information storage section is suitably selected depending on the intended purpose without any restriction, and suitable examples thereof include a magnetic recording layer, a magnetic stripe, an IC memory, an optical memory and an RF-ID tag. In the case where the information storage section is used for process control, product control, etc., an RF-ID tag is particularly preferable. The RF-ID tag is composed of an IC chip, and an antenna connected to the IC chip.

The thermoreversible recording member includes the recording layer capable of reversible display, and the information storage section. Suitable examples of the information storage section include an RF-ID tag.

Figure 9:
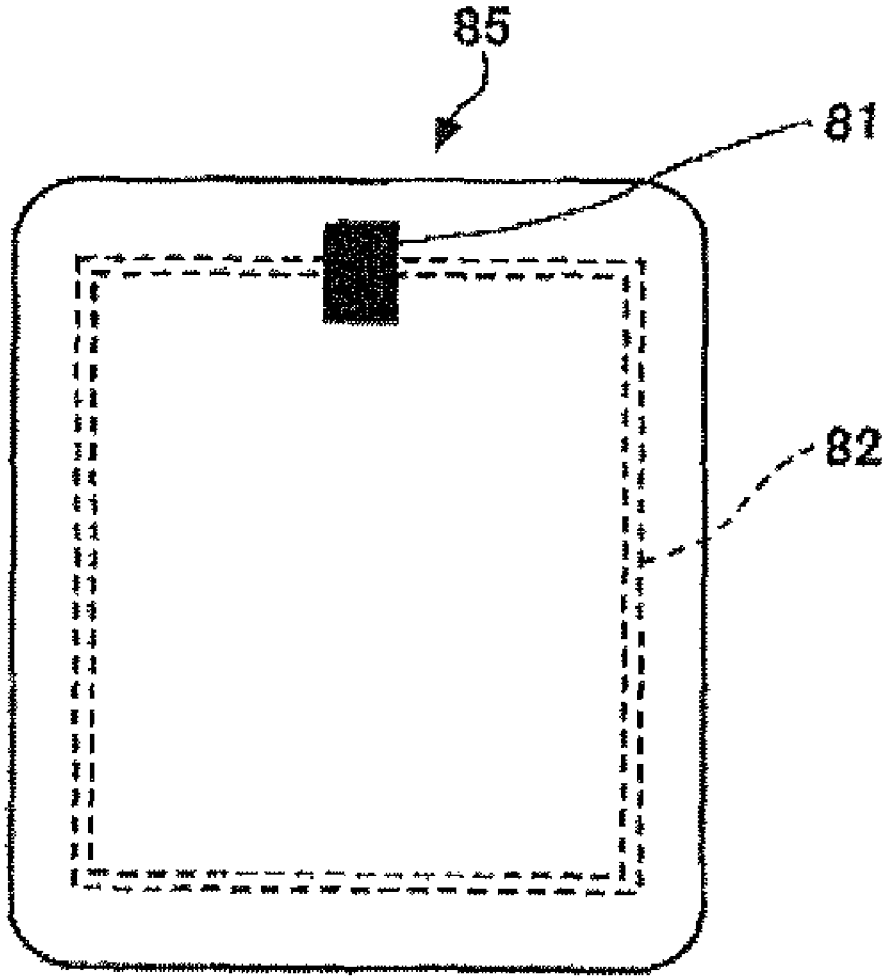
FIG. 9 is a schematic diagram showing one example of a RF-ID tag.

Here, FIG. 9 shows a schematic diagram of an example of an RF-ID tag 85. This RF-ID tag 85 is composed of an IC chip 81, and an antenna 82 connected to the IC chip 81. The IC chip 81 is divided into four sections, i.e. a storage section, a power adjusting section, a transmitting section and a receiving section, and communication is conducted as they perform their operations allotted. As for the communication, the RF-ID tag communicates with an antenna of a reader/writer by means of a radio wave so as to transfer data. Specifically, there are such two methods as follows: an electromagnetic induction method in which the antenna of the RF-ID tag receives a radio wave from the reader/writer, and electromotive force is generated by electromagnetic induction caused by resonance; and a radio wave method in which electromotive force is generated by a radiated electromagnetic field. In both methods, the IC chip inside the RF-ID tag is activated by an electromagnetic field from outside, information inside the chip is converted to a signal, then the signal is emitted from the RF-ID tag. This information is received by the antenna on the reader/writer side and recognized by a data processing unit, then data processing is carried out on the software side.

The RF-ID tag is formed into a label or a card and can be affixed to the thermoreversible recording medium. The RF-ID tag may be affixed to the recording layer surface or the back layer surface, desirably to the back surface layer. To stick the RF-ID tag and the thermoreversible recording medium together, a known adhesive or tackiness agent may be used.

Additionally, the thermoreversible recording medium and the RF-ID tag may be integrally formed by lamination or the like and then formed into a card or a tag.

(Image Processing Device)

An image processing device of the present invention is used in the image processing method of the present invention and includes at least a laser beam emitting unit, a beam scanning unit, a light intensity distribution adjusting unit, and a fθ lens configured to condense laser light, and further includes a cooling unit and may include other members suitably selected in accordance with the necessity.

—Laser Emitting Unit—

The laser emitting unit is suitably selected depending on the intended purpose without any restriction, provided that it is capable of emitting laser light. Examples thereof include conventional lasers such as a $CO_2$ laser, a YAG laser, a fiber laser, and a semiconductor laser (LD).

A wavelength of the laser light emitted from the laser emitting unit is suitably selected depending on the intended purpose without any restriction, but it is preferably in the range of from the visible region to the infrared region, more preferably in the range of from the near infrared region to the far infrared region because an image contrast is improved with the light having a wavelength within this range.

When the wavelength is in the visible region, an additive for absorbing the laser light and generating the heat for image recording and image erasing of the thermoreversible recording medium is colored by the laser beam, and thus may lower the contrast of the image.

The wavelength of the laser light emitted from the $CO_2$ laser is 10.6 μm which is in the far infrared region, and the thermoreversible recording medium absorbs such laser light. Therefore, it is not necessary to add the additive for absorbing the laser light and generating heat for image recording and image erasing of the thermoreversible recording medium. Moreover, this additive may absorb the visible light, even through it is a slight degree, when the laser light having a wavelength in the near infrared region is used. Therefore, the use of the $CO_2$ laser that does not require the additive has an advantage, as lowing of the image contrast can be prevented.

The wavelength of the laser light emitted from the YAG laser, fiber laser, and LD is in the visible to near infrared region (a free hundred micrometers to 1.2 μm). Since the currently available thermoreversible recording medium does not absorb the laser light in this wavelength region, it is necessary to add a photo thermal conversion material for absorbing the laser light and converting to heat. But still, the use of such lasers has an advantage such that recording of highly precise images can be realized because the wavelength of the laser light is short.

In addition, as the YAG laser and fiber laser have high output, there is an advantage such that image recording and image erasing can be high speeded. The LD has an advantage such that the device can be downsized and moreover the price of the device can be set low, as the laser itself is small.

—Beam Scanning Unit—

The beam scanning unit is disposed on a surface from which a laser beam is emitted in the laser beam emitting unit. Examples of the laser beam scanning unit include a laser beam scanning unit with the use of a galvano mirror, and a unit of moving a XY stage on which a thermoreversible recording medium is fixed The unit of moving the XY stage is difficult to scan fine letters/characters at high speed. Therefore, the laser beam scanning unit with the use of a galvano mirror is preferably used as the scanning method.

—Light Intensity Distribution Adjusting Unit—

The light intensity distribution adjusting unit has a function of changing the light intensity distribution of the laser beam.

The arrangement of the light intensity distribution adjusting unit is not particularly limited provided that it is disposed on a surface from which a laser beam is emitted in the laser beam emitting unit; the distance, etc. between the light intensity distribution adjusting unit and the laser beam emitting unit may be suitably selected in accordance with the intended use, and the light intensity distribution adjusting unit is preferably placed between the laser beam emitting unit and the after-mentioned galvano mirror, more preferably between the after-mentioned beam expander and the galvano mirror.

The light intensity distribution adjusting unit has the function to change the light intensity distribution such that the ratio ($I_1/I_2$) of the light intensity ($I_1$) of the applied laser beam in a central position of the applied laser beam to the light intensity ($I_2$) of the applied laser beam on a plane corresponding to 80% of the total irradiation energy of the applied laser beam satisfies $0.4 \leqq I_1/I_2 \leqq 2.0$. Therefore, it is possible to reduce degradation of the thermoreversible recording medium caused by repeated image recording and erasure and to improve durability against repeated use, with the image contrast being maintained.

The light intensity distribution adjusting unit is suitably selected depending on the intended purpose without any restriction. Suitable examples thereof include lenses, filters, masks, mirrors and fiber couplings, with lenses being preferable because of causing less energy loss, specifically kaleidoscopes, integrators, beam homogenizers, aspheric beam shapers (each of which is a combination of an intensity transformation lens and a phase correction lens), aspherical lenses, and diffractive optical elements.

Figure 6A:
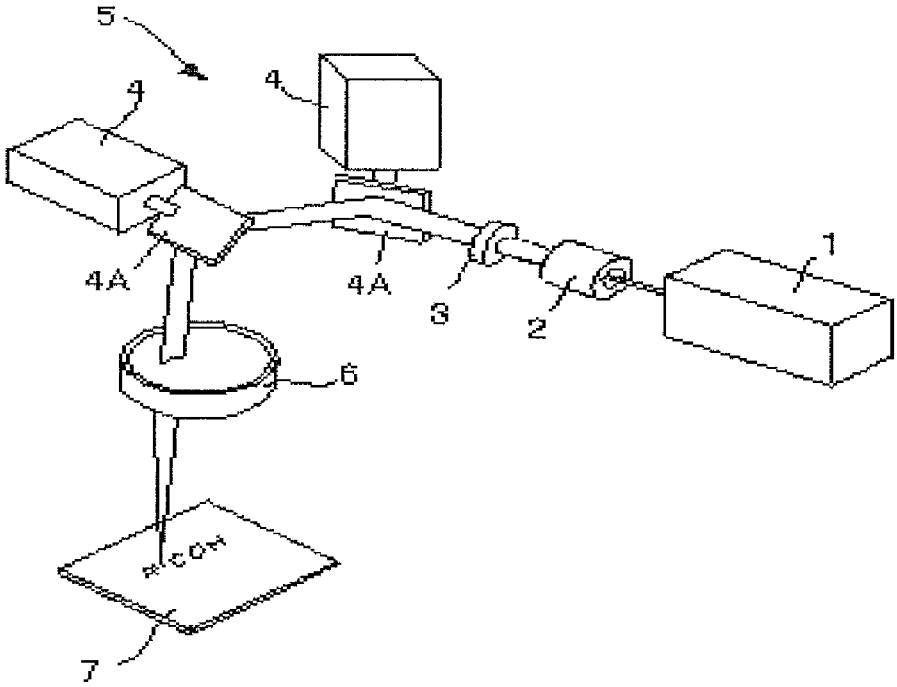
FIG. 6A is a diagram explaining one example of the image processing device of the present invention.
Figure 6B:
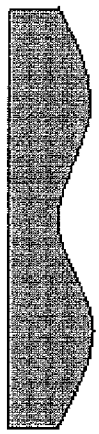
FIG. 6B is a diagram explaining one example of the apephrical lens for use in the present invention.

Among these, aspherical lenses as shown in FIG. 6B is particularly preferable, because of high degree of design flexibility in the intensity distribution adjusting element.

For example, the light intensity can be controlled by adjusting the distance between the thermoreversible recording medium and the fθ lens which is a condenser lens so as not to be identical to the focal length, together with the aspherical lens shown in FIG. 6B.

When a filter, a mask or the like is used, the light intensity can be adjusted by physically cutting a central part of the laser beam. Meanwhile, when a mirror is used, the light intensity can be adjusted by using, for example, a deformable mirror that is linked to a computer and can be mechanically changed in shape, or a mirror in which the reflectance or the formation of depressions and protrusions on the surface varies from part to part. Moreover, the light intensity can be easily adjusted by fiber-coupling a semiconductor laser, YAG laser or the like.

—fθ Lens—

The fθ lens is an element for condensing the laser light onto the thermoreversible recording medium. When a galvanometer mirror is used, a diameter of a condensed beam by a conventional convex lens is varied depending on the scanning position, as the distance from a condenser lens (including the convex lens and a fθ lens) is changed depending on the scanning position on the thermoreversible recording medium. Use of the fθ lens is preferable in this case because the diameter of the condensed beam can be maintained at a constant level regardless of the scanning position on the thermoreversible recording medium.

Although an antireflection film (AR coat) is generally formed on the surface of the fθ lens, the difference between the light intensity distribution of the center portion of the fθ lens and that of the peripheric portion of the fθ lens can be reduced by reducing the thickness of the antireflection film on the peripheric portion of the fθ lens compared to the thickness thereof on the center portion of the fθ lens, or changing the material of the antireflection film to the material having a low reflectance.

The image processing device of the present invention is identical to the one that is generally referred to as a laser marker as a basic structure, other than that the image processing device of the present invention contains at least a laser light emitting unit, a light scanning unit, a light intensity adjusting unit, a fθ lens configured to condense laser light, and contains an oscillator unit, a power supply controlling unit, and a program unit.

Here, one example of the image processing device of the present invention, mainly the laser light emitting unit, is shown in FIG. 6A.

The image processing device shown in FIG. 6A contains an optical lens, as the light intensity adjusting unit, disposed in a light pathway of a laser marker (LP-440, manufactured by SUNX Limited) equipped with a $CO_2$ laser having output of 40 W, and is configured to be able to changeably adjust the light intensity distribution of the laser light at the cross section orthogonal to the traveling direction of the laser light.

Note that, the specifications of the laser emitting unit, namely a head section for image recording and erasing, are as follows. The enable laser output range is 0.1 W to 40 W; the radiation distance moving range is not particularly specified; the range of the spot diameter is 0.18 mm to 10 mm; the scanning speed range is 12,000 mm/s (max); and the radiation distance range is not particularly specified.

The oscillator unit contains a laser oscillator 1, a beam expander 2, a scanning unit 5, and the like.

The laser oscillator 1 is necessary for attaining laser light having high intensity and high directivity. For example, a couple of mirrors are disposed at each sides of a laser medium, the laser medium is pumped (supplied with energy), a number of atoms in the excited state is increased, a population inversion is recorded to thereby induce emission. By selectively amplifying the light in the direction of the optical axis, the directivity of the light is increased, and the laser light is released from the output mirror.

The scanning unit 5 contains a galvanometer 4, and a galvanometer mirror 4A mounted to the galvanometer 4. The laser light output from the laser oscillator 1 is rotary scanned at high speed by two galvanometer mirrors 4A each mounted to the galvanometer 4 and disposed in the directions of X axis and Y axis, respectively, to thereby record or erase an image on a thermoreversible recording medium 7.

The power supply controlling unit contains a power supply for discharging (in the case of a $CO_2$ laser) or a driving power supply (a YAG laser etc.) of a light source configured to excite a laser medium, a driving power supply for the galvanometer, a power supply for cooling such as Peltier element, and a control unit for controlling the entire image processing device.

The program unit is a unit configured to input conditions such as an intensity, scanning velocity and the light of laser light, form and edit characters to be recorded or the like for image recording or image erasing based on input from a touch-panel or keyboard.

Note that, although the laser light emitting unit, namely a head part for image recording and erasing, is mounted to the image processing device, the image processing device contains a conveying unit for the thermoreversible recording medium, a controlling unit thereof, a monitor unit (a touch-panel) and the like, other than the laser light emitting unit.

The image processing method and image processing device of the present invention are capable of repetitively performing image recording and image erasing to a thermoreversible recording medium such as a label attached to a container such as a cardboard box or a plastic container in a non-contact system. In addition, the image processing method and image processing device of the present invention are capable of suppressing the deterioration of the thermoreversible recording medium due to the repetitive use. For this reason, the image processing method and image processing device of the present invention are especially suitably used for distribution and delivery systems. In this case, an image can be recorded on and erased from the label while transferring the cardboard box or plastic container placed on the conveyer belt, and thus the time required for shipping can be reduced as it is not necessary to stop the production line. Moreover, the label attached to the cardboard box or plastic container can be reused in the same state, and image erasing and recording can be performed again without removing the label from the cardboard box or plastic container.

EXAMPLES

Hereinafter, Examples of the present invention will be explained. However, it should be noted that the present invention is not confined to these Examples in any way.

Production Example 1

<Production of Thermoreversible Recording Medium>

A thermoreversible recording medium in which color tone changed reversibly (transparent state-color-developed state) depending upon temperature was produced in the following manner.

—Support—

As a support, a white turbid polyester film (TETORON FILM U2L98W, manufactured by Teijin DuPont Films Japan Limited) having a thickness of 125 μm was used.

—Under Layer—

Thirty (30) parts by mass of a styrene-butadiene copolymer (PA-9159, manufactured by Nippon A&L Inc.), 12 parts by mass of a polyvinyl alcohol resin (POVAL PVA103, manufactured by Kuraray Co., Ltd.), 20 parts by mass of hollow particles (MICROSPHERE R-300, manufactured by Matsumoto Yushi-Seiyaku Co., Ltd.) and 40 parts by mass of water were mixed, and stirred for approximately 1 hr so as to be uniformly mixed, thereby preparing an under layer coating solution.

Next, an under layer having a thickness of 20 μm was formed by applying the obtained under layer coating solution onto the support with the use of a wire bar, then heating and drying the under layer coating solution at 80° C. for 2 min.

—Thermoreversible Recording Layer (Recording Layer)—

Using a ball mill, 5 parts by mass of the reversible developer represented by Structural Formula (1) below, 0.5 parts by mass each of the two types of color erasure accelerators represented by Structural Formulae (2) and (3) below, 10 parts by mass of a 50% acrylpolyol solution (hydroxyl value=200 mgKOH/g), and 80 parts by mass of methyl ethyl ketone were pulverized and dispersed such that the average particle diameter became approximately 1 μm.

—Reversible Developer—

Structural Formula (1)

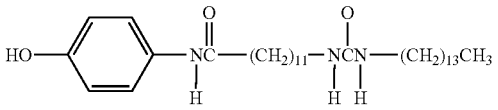

--Color Erasure Accelerator--

Structural Formula (2)

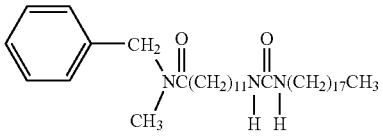

Structural Formula (3)

$C_{17}H_{35}CONHC_{18}H_{35}$

Next, into the dispersion solution in which the reversible developer had been pulverized and dispersed, 1 part by mass of 2-anilino-3-methyl-6-dibutylaminofluoran as a leuco dye, 0.2 parts by mass of the phenolic antioxidant (IRGANOX 565, manufactured by Ciba Specialty Chemicals plc.) represented by Structural Formula (4) below, and 5 parts by mass of an isocyanate (CORONATE HL, manufactured by Nippon Polyurethane Industry Co., Ltd.) were added, and then sufficiently stirred to prepare a recording layer coating solution.

Structural Formula (4)

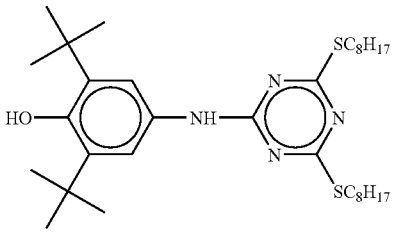

Subsequently, the prepared recording layer coating solution was applied, using a wire bar, onto the support over which the under layer had already been formed, and the recording layer coating solution was dried at 100° C. for 2 min, then cured at 60° C. for 24 hr so as to form a recording layer having a thickness of 11 μm.

—Intermediate Layer—

Three (3) parts by mass of a 50% acrylpolyol resin solution (LR327, manufactured by Mitsubishi Rayon Co., Ltd.), 7 parts by mass of a 30% zinc oxide fine particle dispersion solution (ZS303, manufactured by Sumitomo Cement Co., Ltd.), 1.5 parts by mass of an isocyanate (CORONATE HL, manufactured by Nippon Polyurethane Industry Co., Ltd.), and 7 parts by mass of methyl ethyl ketone were mixed, and sufficiently stirred to prepare an intermediate layer coating solution.

Next, the intermediate layer coating solution was applied, using a wire bar, onto the support over which the under layer and the recording layer had already been formed, and the intermediate layer coating solution was heated and dried at 90° C. for 1 min, and then heated at 60° C. for 2 hr so as to form an intermediate layer having a thickness of 2 μm.

—Protective Layer—

Three (3) parts by mass of pentaerythritol hexaacrylate (KAYARAD DPHA, manufactured by Nippon Kayaku Co., Ltd.), 3 parts by mass of an urethane acrylate oligomer (ART RESIN UN-3320HA, manufactured by Negami Chemical Industrial Co., Ltd.), 3 parts by mass of an acrylic acid ester of dipentaerythritol caprolactone (KAYARAD DPCA-120, manufactured by Nippon Kayaku Co., Ltd.), 1 part by mass of a silica (P-526, manufactured by Mizusawa Industrial Chemicals, Ltd.), 0.5 parts by mass of a photopolymerization initiator (IRGACURE 184, manufactured by Nihon Ciba-Geigy K.K.), and 11 parts by mass of isopropyl alcohol were mixed, and sufficiently stirred and dispersed by the use of a ball mill, such that the average particle diameter became approximately 3 μm, thereby preparing a protective layer coating solution.

Next, the protective layer coating solution was applied, using a wire bar, onto the support over which the under layer, the recording layer and the intermediate layer had already been formed, and the protective layer coating solution was heated and dried at 90° C. for 1 min, then cross-linked by means of an ultraviolet lamp of 80 W/cm, so as to form a protective layer having a thickness of 4 μm.

—Back Layer—

Pentaerythritol hexaacrylate (KAYARAD DPHA, manufactured by Nippon Kayaku Co., Ltd.) (7.5 parts by mass), 2.5 parts by mass of an urethane acrylate oligomer (ART RESIN UN-3320HA, manufactured by Negami Chemical Industrial Co., Ltd.), 2.5 parts by mass of a needle-like conductive titanium oxide (FT-3000, major axis=5.15 μm, minor axis=0.27 μm, structure: titanium oxide coated with antimony-doped tin oxide; manufactured by Ishihara Sangyo Kaisha, Ltd.), 0.5 parts by mass of a photopolymerization initiator (IRGACURE 184, manufactured by Nihon Ciba-Geigy K.K.) and 13 parts by mass of isopropyl alcohol were mixed, and sufficiently stirred by the use of a ball mill, so as to prepare a back layer coating solution.

Next, the back layer coating solution was applied, using a wire bar, onto the surface of the support opposite to the surface thereof over which the recording layer, the intermediate layer and the protective layer had already been formed, and the back layer coating solution was heated and dried at 90° C. for 1 min, then cross-linked by means of an ultraviolet lamp of 80 W/cm, so as to form a back layer having a thickness of 4 μm. Thus, a thermoreversible recording medium of Production Example 1 was produced.

Production Example 2

<Production of Thermoreversible Recording Medium>

A thermoreversible recording medium in which transparency changed reversibly (transparent state-white turbid state) depending upon temperature was produced in the following manner.

—Support—

As a support, a transparent PET film (LUMIRROR 175-T12, manufactured by Toray Industries, Inc.) having a thickness of 175 μm was used.

—Thermoreversible Recording Layer (Recording Layer)—

Into a resin-containing solution in which 26 parts by mass of a vinyl chloride copolymer (M 110, manufactured by ZEON CORPORATION) was dissolved in 210 parts by mass of methyl ethyl ketone, 3 parts by mass of the low-molecular organic material represented by Structural Formula (5) below and 7 parts by mass of docosyl behenate were added, and then, in a glass jar, ceramic beads having a diameter of 2 mm were set, and the mixture was dispersed for 48 hr using PAINT SHAKER (manufactured by Asada Iron Works. Co., Ltd), so as to prepare a uniformly dispersed solution.

Structural Formula (5)

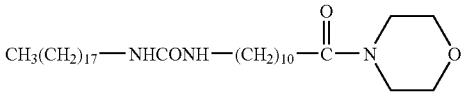

Next, in the obtained dispersion solution, 4 parts by mass of an isocyanate compound (CORONATE 2298-90T, manufactured by Nippon Polyurethane Industry Co., Ltd.) was added, and then sufficiently stirred to prepare a recording layer coating solution.

Subsequently, the obtained recording layer solution was applied on the support, then heated and dried; thereafter, the dried recording layer solution was stored at 65° C. for 24 hr, so as to cross-link the resin. Thus, a thermosensitive recording layer having a thickness of 10 μm was provided over the support.

—Protective Layer—

A solution containing 10 parts by mass of a 75% butyl acetate solution of urethane acrylate ultraviolet curable resin (UNIDIC C7-157, manufactured by Dainippon Ink and Chemicals, Incorporated) and 10 parts by mass of isopropyl alcohol was applied, using a wire bar, onto the thermosensitive recording layer, then heated and dried; thereafter, the solution was cured by ultraviolet irradiation with a high-pressure mercury-vapor lamp of 80 W/cm, so as to form a protective layer having a thickness of 3 μm. Thus, a thermoreversible recording medium of Production Example 2 was produced.

Production Example 3

—Preparation of Thermoreversible Recording Medium—

The thermoreversible recording medium of Production Example 3 was prepared in the same manner as in Production Example 1, provided that 0.03 parts by mass of photothermal conversion material (EXCOLOR IR-14, manufactured by NIPPON SHOKUBAI Co., Ltd.) was added to the recording layer in the process of the production of the thermoreversible recording medium.

<Energy of Laser Light>

The energy of laser light is an energy amount of the laser light emitted on a thermoreversible recording medium per length unit in the scanning direction.

The energy of laser light was determined by the following Formula 2:

$$E=P/V \qquad \text{Formula 2}$$

In Formula 2, E is an energy of laser light, P is an output of the laser light, and V is a scanning linear velocity of the laser light.

<Measurement of Light Intensity Distribution of Laser Light>

The intensity distribution of laser light was measured in the following manner.

When a $CO_2$ laser device was used as a laser, the intensity of laser light was measured using a high-power laser beam analyzer (LPK-$CO_2$-16, manufactured by Ophir-Spiricon Inc.) by reducing light using a Zn—Se wedge (LBS-100-IR-W, manufactured by Ophir-Spiricon Inc.) and a $CaF_2$ filter (LBS-100-IR-F, manufactured by Ophir-Spiricon Inc.) so that the laser output was adjusted to be 0.05%. Then, the obtained intensity of the laser light was profiled on a three-dimensional graph to thereby obtain a light intensity distribution of the laser light.

When a semiconductor laser device was used as a laser, a laser beam analyzer (Scorpion SCOR-20SCM, manufactured by Point Grey Research, Inc.) was positioned so that the emitting distance was to be identical to the distance at the time of recording a thermoreversible recording medium, and then the intensity of laser light was measured by the laser beam analyzer by reducing light using a beam splitter (BEAMSTAR-FX-BEAM SPLITTER, manufactured by Ophir Optronics Ltd.) that was a combination of a transmissive mirror and a filter so that the output of the laser was adjusted to be $3\times10^{-6}$. Then, the obtained intensity of the laser light was profiled on a three-dimensional graph to thereby obtain a light intensity distribution of the laser light.

$I_1$ was obtained from the light intensity of the center portion of the emitted laser light, and $I_2$ was obtained from the light intensity of a 80% plane of the total radiation energy of the laser light.

—Determination of a Center Portion and Peripheric Portion of fθ Lens—

Here, the area where the laser light was capable of illuminating was set from the central point of the area where the laser light was capable of illuminating to 75 mm through the control of a mirror disposed in the image processing device to which the laser light source was mounted. The thermoreversible recording medium was evaluated at the central point of the area where the laser light was capable of illuminating as the center portion of the fθ lens, and at a position which was 60 mm apart from the central point of the area where the laser light was capable of illuminating as the peripheric portion of the fθ lens.

Example 1

<Adjustment of Laser Output Condition>

<<No. 1>>

—Image Recording Step—

The thermoreversible recording medium of Production Example 1 was used; a laser radiation distance from a fθ lens to the thermoreversible recording medium was adjusted to 184 mm using a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm) so that the light intensity distribution $I_1/I_2$ of the laser light passing through the center portion of the fθ lens and traveling onto the thermoreversible recording medium was adjusted to 1.6. An image was recorded on the thermoreversible recording medium under the conditions such that the output and scanning linear velocity of the laser light passing through the center portion of the fθ lens and traveling onto the thermoreversible recording medium were respectively 20 W, and 1,800 mm/s, and the output and scanning linear velocity of the laser light passing through the peripheric portion of the fθ lens and traveling onto the thermoreversible recording medium were respectively 22 W, and was 1,800 mm/s.

—Image Erasing Step—

The thermoreversible recording medium of Production Example 1 was used, and the image was erased from the thermoreversible recording medium by means of a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm), adjusting the radiation distance, scanning linear velocity, and spot diameter at 245 mm, 1,750 mm/s, and 3.0 mm, respectively. The outputs of the laser irradiating the center portion and peripheric portion of the fθ lens were adjusted to 22 W.

<<No. 2>>

Image recording and image erasing were carried out in the same manner as in No. 1, provided that the output of the laser light passing through the peripheric portion of the fθ lens and traveling onto the thermoreversible recording medium was changed to 20 W in the image recording step.

<<No. 3>>

Image recording and image erasing were carried out in the same manner as in No. 1, provided that the output of the laser light passing through the peripheric portion of the fθ lens and traveling onto the thermoreversible recording medium was changed to 19 W in the image recording step.

<<No. 4>>

Image recording and image erasing were carried out in the same manner as in No. 1, provided that the output of the laser light passing through the peripheric portion of the fθ lens and traveling onto the thermoreversible recording medium was changed to 18 W in the image recording step.

<<No. 5>>

Image recording and image erasing were carried out in the same manner as in No. 1, provided that the output of the laser light passing through the peripheric portion of the fθ lens and traveling onto the thermoreversible recording medium was changed to 16.6 W in the image recording step.

<<No. 6>>

Image recording and image erasing were carried out in the same manner as in No. 1, provided that the output of the laser light passing through the peripheric portion of the fθ lens and traveling onto the thermoreversible recording medium was changed to 14 W in the image recording step.

Next, Nos. 1 to 6 were subjected to the measurements of an image line width and repeating durability, and were evaluated based on the obtained measurements. The results are shown in Tables 2-1 and 2-2.

<Measurement of Image Line Width>

The image line width was measured. The measurement of the image line width was carried out in the following manner. At first, a gray scale (manufactured by Eastman Kodak Company) was read by a scanner (Canoscan4400, manufactured by Canon Inc.), a correlation was taken between the obtained digital gradation value and a gray level measured by a reflection densitometer (RD-914, manufactured by GretagMacbeth), then the digital gradation value obtained by reading the image recorded as mentioned above by means of the scanner was converted to the gray level, and the width when the gray level became 0.5 or more was calculated from the set pixel number (1,200 dpi) of the digital gradation value as a line width. Thereafter, obtained result was evaluated based on the following criteria.

[Evaluation Criteria]

A: The image line width [mm] of the center portion of the fθ lens is 0.35 or more, and a difference between the image line width [mm] of the center portion of the fθ lens and the image line width [mm] of the peripheric portion of the fθ lens was 0.05 or less.

B: The image line width [mm] of the center portion of the fθ lens is 0.27 or more, and a difference between the image line width [mm] of the center portion of the fθ lens and the image line width [mm] of the peripheric portion of the fθ lens was 0.06 to 0.13.

C: The image line width [mm] of the center portion of the fθ lens is less than 0.27, and a difference between the image line width [mm] of the center portion of the fθ lens and the image line width [mm] of the peripheric portion of the fθ lens was 0.14 or more.

<Measurement of Repeating Durability>

The image recording and image erasing were repeated, and after every 10 times, the image density of the erased portion was measured, and the repeated number of when the image density of the erased portion (the remained image) became 0.15 or more was determined. Then, the result was evaluated based on the following criteria.

[Evaluation Criteria]

A: The repeating durability [number] of the center portion of the fθ lens was 200 or more, and a difference between the repeating durability [number] of the center portion of the fθ lens and the repeating durability [number] of the peripheric portion of the fθ lens was 120 or less.

B: The repeating durability [number] of the center portion of the fθ lens was 140 or more, and a difference between the repeating durability [number] of the center portion of the fθ lens and the repeating durability [number] of the peripheric portion of the fθ lens was 130 to 230.

C: A difference between the repeating durability [number] of the center portion of the fθ lens and the repeating durability [number] of the peripheric portion of the fθ lens was 240 or more.

TABLE 1-1

| | | | Center portion of fθ lens | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 1 | 110 | 100 | 1.6 | 0.011 | 20 | 1800 | Comp. |
| No. 2 | 100 | 100 | 1.6 | 0.011 | 20 | 1800 | Comp. |
| No. 3 | 95 | 100 | 1.6 | 0.011 | 20 | 1800 | Present invention |
| No. 4 | 90 | 100 | 1.6 | 0.011 | 20 | 1800 | Present invention |
| No. 5 | 83 | 100 | 1.6 | 0.011 | 20 | 1800 | Present invention |
| No. 6 | 70 | 100 | 1.6 | 0.011 | 20 | 1800 | Present invention |

TABLE 1-2

| | Peripheric portion of fθ lens | | | |
|---|---|---|---|---|
| | Energy E2 | Output P2[W] | Scanning linear velocity V2 [mm/s] | |
| No. 1 | 0.012 | 22 | 1800 | Comp. |
| No. 2 | 0.011 | 20 | 1800 | Comp. |
| No. 3 | 0.01 | 19 | 1800 | Present invention |
| No. 4 | 0.01 | 18 | 1800 | Present invention |
| No. 5 | 0.009 | 16.6 | 1800 | Present invention |
| No. 6 | 0.007 | 14 | 1800 | Present invention |

TABLE 2-1

| | Repeating durability | | | |
|---|---|---|---|---|
| | Center portion of fθ lens (number) | Peripheric portion of fθ lens (number) | Evaluation | |
| No. 1 | 390 | 90 | C | Comp. |
| No. 2 | 390 | 170 | B | Comp. |
| No. 3 | 390 | 280 | A | Present invention |
| No. 4 | 390 | 360 | A | Present invention |
| No. 5 | 390 | 510 | A | Present invention |
| No. 6 | 390 | 680 | A | Present invention |

TABLE 2-2

| | Image line width | | | |
|---|---|---|---|---|
| | Center portion of fθ lens (mm) | Peripheric portion of fθ lens (mm) | Evaluation | |
| No. 1 | 0.35 | 0.38 | A | Comp. |
| No. 2 | 0.35 | 0.35 | A | Comp. |
| No. 3 | 0.35 | 0.34 | A | Present invention |
| No. 4 | 0.35 | 0.32 | A | Present invention |
| No. 5 | 0.35 | 0.29 | B | Present invention |
| No. 6 | 0.35 | 0.22 | B | Present invention |

From the results shown in Tables 1-1, 1-2, 2-1 and 2-2, in Nos. 3 to 6, both repeating durability and image line width were attained on the irradiated portions of the laser light passing through the center portion of the fθ lens and traveling onto the thermoreversible recording medium and the laser light passing through the peripheric portion of the fθ lens and traveling onto the thermoreversible recording medium, by reducing the output of the laser light passing through the peripheric portion of the fθ lens and traveling onto the thermoreversible recording medium compared to the output of the laser light passing through the center portion of the fθ lens and traveling onto the thermoreversible recording medium.

Note that, in No. 6, as the value of (P2/P1)×100 was less than 80%, the image line width was slightly lowered even though the repeating durability of the irradiated portion of the laser light passing through the center portion of the fθ lens and traveling onto the thermoreversible recording medium.

In comparison with this, in Nos. 1 and 2, as the value of (P2/P1)×100 was more than 99%, the repeating durability of the irradiated portion of the laser light passing through the peripheric portion of the fθ lens and traveling onto the thermoreversible recording medium was significantly lowered.

Example 2

<Adjustment of Scanning Linear Velocity>

<<No. 7>>

—Image Recording Step—

The thermoreversible recording medium of Production Example 1 was used; a laser radiation distance from a fθ lens to the thermoreversible recording medium was adjusted to 184 mm using a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm) so that the light intensity distribution $I_1/I_2$ of the laser light passing through the center portion of the fθ lens and traveling onto the thermoreversible recording medium was adjusted to 1.6. An image was recorded on the thermoreversible recording medium under the conditions such that the output and scanning linear velocity of the laser light passing through the center portion of the fθ lens and traveling onto the thermoreversible recording medium were respectively 20 W, and 1,800 mm/s, and the output and scanning linear velocity of the laser light passing through the peripheric portion of the fθ lens and traveling onto the thermoreversible recording medium were respectively 20 W, and was 1,620 mm/s.

—Image Erasing Step—

The thermoreversible recording medium of Production Example 1 was used, and the image was erased from the thermoreversible recording medium by means of a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm), adjusting the radiation distance, scanning linear velocity, and spot diameter at 245 mm, 1,750 mm/s, and 3.0 mm, respectively. The output of the laser irradiating the center portion and peripheric portion of the fθ lens was adjusted to 22 W. The light intensity distribution $I_1/I_2$ of the laser light at the time of image erasing was 2.3.

<<No. 8>>

Image recording and image erasing were carried out in the same manner as in No. 7, provided that the scanning linear velocity of the laser light passing through the peripheric portion of the fθ lens and traveling onto the thermoreversible recording medium was changed to 1,890 mm/s.

<<No. 9>>

Image recording and image erasing were carried out in the same manner as in No. 7, provided that the scanning linear velocity of the laser light passing through the peripheric portion of the fθ lens and traveling onto the thermoreversible recording medium was changed to 2,000 mm/s.

<<No. 10>>

Image recording and image erasing were carried out in the same manner as in No. 7, provided that the scanning linear velocity of the laser light passing through the peripheric portion of the fθ lens and traveling onto the thermoreversible recording medium was changed to 2,170 mm/s.

<<No. 11>>

Image recording and image erasing were carried out in the same manner as in No. 7, provided that the scanning linear velocity of the laser light passing through the peripheric portion of the fθ lens and traveling onto the thermoreversible recording medium was changed to 2,570 mm/s.

Next, Nos. 7 to 11 were subjected to the measurements of the image line width and repeating durability, and the results were evaluated in the same manner as in Example 1. The results are shown in Tables 4-1 and 4-2 together with the result of No. 2.

TABLE 3-1

| | Center portion of fθ lens | | | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 7 | 100 | 90 | 1.6 | 0.011 | 20 | 1800 | Comp. |
| No. 2 | 100 | 100 | 1.6 | 0.011 | 20 | 1800 | Comp. |
| No. 8 | 100 | 105 | 1.6 | 0.011 | 20 | 1800 | Present invention |
| No. 9 | 100 | 111 | 1.6 | 0.011 | 20 | 1800 | Present invention |
| No. 10 | 100 | 120 | 1.6 | 0.011 | 20 | 1800 | Present invention |
| No. 11 | 100 | 142 | 1.6 | 0.011 | 20 | 1800 | Present invention |

TABLE 3-2

| | Peripheric portion of fθ lens | | | |
|---|---|---|---|---|
| | Energy E2 | Output P2[W] | Scanning linear velocity V2 [mm/s] | |
| No. 7 | 0.012 | 20 | 1620 | Comp. |
| No. 2 | 0.011 | 20 | 1800 | Comp. |
| No. 8 | 0.01 | 20 | 1890 | Present invention |
| No. 9 | 0.01 | 20 | 2000 | Present invention |
| No. 10 | 0.009 | 20 | 2170 | Present invention |
| No. 11 | 0.007 | 20 | 2570 | Present invention |

TABLE 4-1

| | Repeating durability | | | |
|---|---|---|---|---|
| | Center portion of fθ lens (number) | Peripheric portion of fθ lens (number) | Evaluation | |
| No. 7 | 390 | 90 | C | Comp. |
| No. 2 | 390 | 170 | B | Comp. |
| No. 8 | 390 | 270 | A | Present invention |

TABLE 4-1-continued

| | Repeating durability | | | |
|---|---|---|---|---|
| | Center portion of fθ lens (number) | Peripheric portion of fθ lens (number) | Evaluation | |
| No. 9 | 390 | 350 | A | Present invention |
| No. 10 | 390 | 500 | A | Present invention |
| No. 11 | 390 | 660 | A | Present invention |

TABLE 4-2

| | Image line width | | | |
|---|---|---|---|---|
| | Center portion of fθ lens (mm) | Peripheric portion of fθ lens (mm) | Evaluation | |
| No. 7 | 0.35 | 0.39 | A | Comp. |
| No. 2 | 0.35 | 0.35 | A | Comp. |
| No. 8 | 0.35 | 0.34 | A | Present invention |
| No. 9 | 0.35 | 0.33 | A | Present invention |
| No. 10 | 0.35 | 0.29 | B | Present invention |
| No. 11 | 0.35 | 0.21 | B | Present invention |

From the results shown in Tables 3-1, 3-2, 4-1 and 4-2, in Nos. 8 to 11, both repeating durability and image line width were attained on the irradiated portions of the laser light passing through the center portion of the fθ lens and traveling onto the thermoreversible recording medium and the laser light passing through the peripheric portion of the fθ lens and traveling onto the thermoreversible recording medium, by increasing the scanning linear velocity of the laser light passing through the peripheric portion of the fθ lens and traveling onto the thermoreversible recording medium compared to the scanning linear velocity of the laser light passing through the center portion of the fθ lens and traveling onto the thermoreversible recording medium.

Note that, in Nos. 7 and 2, as the value of (V2/V1)×100 was less than 101%, the repeating durability was lowered on the irradiated portion of the laser light passing through the peripheric portion of the fθ lens and traveling onto the thermoreversible recording medium. In comparison with this, in No. 10, as the value of (V2/V1)×100 was more than 120%, the line width was slightly lowered even through the repeating durability on the irradiated portion of the laser light passing through the peripheric portion of the fθ lens and traveling onto the thermoreversible recording medium was satisfactory.

Example 3

<Adjustment of Condition of Light Intensity Distribution>

<<No. 12>>

—Image Recording Step—

The thermoreversible recording medium of Production Example 1 was used; a laser radiation distance from a fθ lens to the thermoreversible recording medium was adjusted to 178 mm using a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm) so that the light intensity distribution $I_1/I_2$ of the laser light passing through the center portion of the fθ lens and traveling onto the thermoreversible recording medium was adjusted to 0.2. An image was recorded on the thermoreversible recording medium under the conditions such that the output and scanning linear velocity of the laser light passing through the center portion of the fθ lens and traveling onto the thermoreversible recording medium were respectively 37.5 W, and 1,800 mm/s, and the output and scanning linear velocity of the laser light passing through the peripheric portion of the fθ lens and traveling onto the thermoreversible recording medium were respectively 33.8 W, and was 1,800 mm/s.

—Image Erasing Step—

The thermoreversible recording medium of Production Example 1 was used, and the image was erased from the thermoreversible recording medium by means of a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm), adjusting the radiation distance, scanning linear velocity, and spot diameter at 245 mm, 1,750 mm/s, and 3.0 mm, respectively. The output of the laser transmitting the center portion and peripheric portion of the thermoreversible recording medium was adjusted to 40 W.

<<No. 13>>

—Image Recording Medium—

Image recording was carried out in the same manner as in No. 12, provided that the laser radiation distance from the fθ lens to the thermoreversible recording medium was adjusted to 188 mm, the light intensity distribution $I_1/I_2$ of the laser light passing through the center portion of the fθ lens and traveling onto the thermoreversible recording medium was changed to 2.3, the output of the laser light passing through the center portion of the fθ lens and traveling onto the thermoreversible recording medium was changed to 11.3 W, and the output of the laser light passing through the peripheric portion of the fθ lens and traveling onto the thermoreversible recording medium was changed to 10.2 W.

—Image Erasing Step—

Image Erasing was carried out in the same manner as in No. 12, provided that the outputs of the laser light passing through the center and peripheric portions of the fθ lens were changed to 13 W.

Next, Nos. 12 and 13 were subjected to the measurements of the image line width and repeating durability, and the results were evaluated in the same manner as Example 1. The results are shown in Tables 6-1 and 6-2 together with the result of No. 3.

TABLE 5-1

| | | | Center portion of fθ lens | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 12 | 90 | 100 | 0.2 | 0.02 | 37.5 | 1800 | Present invention |
| No. 3 | 90 | 100 | 1.6 | 0.011 | 20 | 1800 | Present invention |
| No. 13 | 90 | 100 | 2.3 | 0.006 | 11.3 | 1800 | Present invention |

TABLE 5-2

| | Peripheric portion of fθ lens | | | |
|---|---|---|---|---|
| | Energy E2 | Output P2[W] | Scanning linear velocity V2 [mm/s] | |
| No. 12 | 0.018 | 33.8 | 1800 | Present invention |
| No. 3 | 0.01 | 18 | 1800 | Present invention |
| No. 13 | 0.005 | 10.2 | 1800 | Present invention |

TABLE 6-1

| | Repeating durability | | | |
|---|---|---|---|---|
| | Center portion of fθ lens (number) | Peripheric portion of fθ lens (number) | Evaluation | |
| No. 12 | 150 | 120 | B | Present invention |
| No. 3 | 390 | 280 | A | Present invention |
| No. 13 | 140 | 130 | B | Present invention |

TABLE 6-2

| | Image line width | | | |
|---|---|---|---|---|
| | Center portion of fθ lens (mm) | Peripheric portion of fθ lens (mm) | Evaluation | |
| No. 12 | 0.65 | 0.59 | A | Present invention |
| No. 3 | 0.35 | 0.34 | A | Present invention |
| No. 13 | 0.27 | 0.25 | B | Present invention |

From the results of Tables 5-1, 5-2, 6-1 and 6-2, in No. 3, the repeating durability of the irradiated portion resulted in satisfactory by adjusting the light intensity distribution of the laser light passing through the center portion of the fθ lens and traveling onto the thermoreversible recording medium so as to satisfy the relationship of $0.40 \leqq I_1/I_2 \leqq 2.00$, and reducing the output of the laser light passing through the peripheric portion of the fθ lens and traveling onto the thermoreversible recording medium compared to the output of the laser light passing through the center portion of the fθ lens and traveling onto the thermoreversible recording medium.

As the light intensity distribution did not satisfy the relationship of $0.40 \leqq I_1/I_2 \leqq 2.00$ in Nos. 12 and 13, the repeating durability of the irradiated portion was slightly lowered.

Example 4

<Presence of Aspherical Lens>

<<No. 14>>

Image recording and image erasing were carried out in the same manner as in No. 2, provided that the aspherical lens was removed from the $CO_2$ laser (LP-440, manufactured by SUNX Limited).

Next, No. 14 was subjected to the measurements of the image line width and repeating durability, and the results were evaluated in the same manner as in Example 1. The results are shown in Tables 8-1 and 8-2 together with the results of Nos. 4 and 2.

TABLE 7-1

| | Center portion of fθ lens | | | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 4 | 90 | 100 | 1.6 | 0.011 | 20 | 1800 | Present invention |
| No. 2 | 100 | 100 | 1.6 | 0.011 | 20 | 1800 | Comp. |
| No. 14 | 100 | 100 | 2.3 | 0.011 | 20 | 1800 | Comp. |

TABLE 7-2

| | Peripheric portion of fθ lens | | | |
|---|---|---|---|---|
| | Energy E2 | Output P2[W] | Scanning linear velocity V2 [mm/s] | |
| No. 4 | 0.01 | 18 | 1800 | Present invention |
| No. 2 | 0.011 | 20 | 1800 | Comp. |
| No. 14 | 0.011 | 20 | 1800 | Comp. |

TABLE 8-1

| | Repeating durability | | | |
|---|---|---|---|---|
| | Center portion of fθ lens (number) | Peripheric portion of fθ lens (number) | Evaluation | |
| No. 4 | 390 | 360 | A | Present invention |
| No. 2 | 390 | 170 | B | Comp. |
| No. 14 | 80 | 90 | C | Comp. |

TABLE 8-2

| | Image line width | | | |
|---|---|---|---|---|
| | Center portion of fθ lens (mm) | Peripheric portion of fθ lens (mm) | Evaluation | |
| No. 4 | 0.35 | 0.32 | A | Present invention |
| No. 2 | 0.35 | 0.35 | A | Comp. |
| No. 14 | 0.27 | 0.26 | B | Comp. |

From the results of Tables 7-1, 7-2, 8-1 and 8-2, as the aspherical lens was disposed in No. 4, the repeating durability and the image line width were satisfactory.

Although the aspherical lens was disposed in No. 2, the repeating durability was lowered because the output of the laser light passing through the peripheric portion of the fθ lens was larger than that of No. 4.

No. 14 was the example where the aspherical lens was removed from No. 2, and the similar level of energy was applied from the laser light passing through the center portion of the fθ lens and traveling onto the thermoreversible recording medium and from the laser light passing through the peripheric portion of the fθ lens and traveling onto the thermoreversible recording medium because the aspherical lens was removed. Accordingly, there was no difference in the repeating durability and image line width between the center portion and the peripheric portion. However, it was found that excessive energy was applied to the entire surface of the thermoreversible recording medium as the light intensity distribution of the laser light passing through the center portion of the fθ lens and traveling onto the thermoreversible recording medium could not be controlled, resulting in lowering the repeating durability of the irradiated portion.

Comparative Example 1

<Use of Thermoreversible Recording Medium of Production Example 2>

—Image Recording Step—

The thermoreversible recording medium of Production Example 2 was used; a laser radiation distance from a fθ lens to the thermoreversible recording medium was adjusted to 184 mm using a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm) so that the light intensity distribution $I_1/I_2$ of the laser light passing through the center portion of the fθ lens and traveling onto the thermoreversible recording medium was adjusted to 1.6. An image was recorded on the thermoreversible recording medium under the conditions such that the output and scanning linear velocity of the laser light passing through the center portion of the fθ lens and traveling onto the thermoreversible recording medium were respectively 18.3 W, and 1,800 mm/s, and the output and scanning linear velocity of the laser light passing through the peripheric portion of the fθ lens and traveling onto the thermoreversible recording medium were respectively 18.3 W, and was 1,800 mm/s.

—Image Erasing Step—

Next, the image was erased from the thermoreversible recording medium by means of a $CO_2$ laser (LP-440, manufactured by SUNX Limited) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 32.5 mm), adjusting the radiation distance, scanning linear velocity, and spot diameter at 245 mm, 1,750 mm/s, and 3.0 mm, respectively. The output of the laser irradiating the center portion and peripheric portion of the fθ lens was adjusted to 19 W.

—Measurement of Image Line Width—

The image line width was measured. The measurement of the image line width was carried out in the following manner. At first, a gray scale (manufactured by Eastman Kodak Company) was read by a scanner (Canoscan4400, manufactured by Canon Inc.), a correlation was taken between the obtained digital gradation value and a gray level measured by a reflection densitometer (RD-914, manufactured by GretagMacbeth), then the digital gradation value obtained by reading the image recorded as mentioned above by means of the scanner was converted to the gray level, and the width when the gray level became 0.5 or more was calculated from the set pixel number (1,200 dpi) of the digital gradation value as a line width. Thereafter, obtained result was evaluated in the same manner as in Example 1 The results are shown in Tables 10-1 and 10-2.

—Measurement of Repeating Durability—

The image recording and image erasing were repeated, and after every 10 times, the image density of the erased portion was measured, and the repeated number of when the image density of the erased portion (the remained image) became 1.5 or more was determined. Then, the result was evaluated in the same manner as in Example 1. The results are shown in Tables 10-1 and 10-2.

Example 5

<Thermoreversible Recording Medium of Production Example 2>

The image recording was carried out in the same manner as in Comparative Example 1, provided that the light intensity distribution $I_1/I_2$ of the laser light passing through the center portion of the fθ lens and traveling onto the thermoreversible recording medium was changed to 2.3, the output of the laser light passing through the center portion of the fθ lens and traveling onto the thermoreversible recording medium was changed to 18.0 W, and the output of the laser light passing through the peripheric portion of the fθ lens and traveling onto the thermoreversible recording medium was changed to 16.5 W.

Next, the image erasing step, measurement of the image line width, and measurement of the repeating durability were carried out and evaluated in the same manner as in Comparative Example 1. The results are shown in Tables 10-1 and 10-2.

Example 6

<Thermoreversible Recording Medium of Production Example 2>

—Image Recording Step—

The image recording was carried out in the same manner as in Comparative Example 1, provided that the light intensity distribution $I_1/I_2$ of the laser light passing through the center portion of the fθ lens and traveling onto the thermoreversible recording medium was changed to 2.3, the output and scanning linear velocity of the laser light passing through the center portion of the fθ lens and traveling onto the thermoreversible recording medium were respectively changed to 18 W, and 1,800 mm/s, and the output and scanning linear velocity of the laser light passing through the peripheric portion of the fθ lens and traveling onto the thermoreversible recording medium were respectively changed to 18 W and 1,980 mm/s.

Next, the image erasing step, measurement of the image line width, and measurement of the repeating durability were carried out and evaluated in the same manner as in Comparative Example 1. The results are shown in Tables 10-1 and 10-2.

TABLE 9-1

| | | | Center portion of fθ lens | | | |
|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] |
| Comp. Ex. 1 | 100 | 100 | 1.6 | 0.01 | 18.3 | 1800 |
| Ex. 5 | 91 | 100 | 2.3 | 0.01 | 18 | 1800 |
| Ex. 6 | 100 | 110 | 2.3 | 0.01 | 18 | 1800 |

TABLE 9-2

| | Peripheric portion of fθ lens | | |
|---|---|---|---|
| | Energy E2 | Output P2 [W] | Scanning linear velocity V2 [mm/s] |
| Comp. Ex. 1 | 0.01 | 18.3 | 1800 |
| Ex. 5 | 0.009 | 16.5 | 1800 |
| Ex. 6 | 0.009 | 18 | 1980 |

TABLE 10-1

| | Repeating durability | | |
|---|---|---|---|
| | Center portion of fθ lens (number) | Peripheric portion of fθ lens (number) | Evaluation |
| Comp. Ex. 1 | 720 | 350 | C |
| Ex. 5 | 720 | 710 | A |
| Ex. 6 | 720 | 700 | A |

TABLE 10-2

| | Image line width | | |
|---|---|---|---|
| | Center portion of fθ lens (mm) | Peripheric portion of fθ lens (mm) | Evaluation |
| Comp. Ex. 1 | 0.35 | 0.34 | A |
| Ex. 5 | 0.35 | 0.32 | A |
| Ex. 6 | 0.35 | 0.33 | A |

From the results of Tables 9-1, 9-2, 10-1 and 10-2, it was found that, in Examples 5 and 6, the repeating durability of the irradiated portion and image linear velocity were satisfactory by making the value of P2 smaller than the value of P1, or making the value of V2 bigger than the value of V1, even when the thermoreversible recording medium of Production Example 2 was used. Note that, in Comparative Example 1, the repeating durability was lowered because the value of P2 and the value of P1 were identical and the value of V2 and the value of V1 were identical.

Example 7

<Adjustment of Laser Output Conditions>

<<No. 15>>

<Thermoreversible Recording Medium of Production Example 3>

—Image Recording Step—

The thermoreversible recording medium of Production Example 3 was used; a laser radiation distance from a fθ lens to the thermoreversible recording medium was adjusted to 158 mm using a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 150 mm, effective radius R: 30 mm) so that the light intensity distribution $I_1/I_2$ of the laser light passing through the center portion of the fθ lens and traveling onto the thermoreversible recording medium was adjusted to 1.3. An image was recorded on the thermoreversible recording medium under the conditions such that the output and scanning linear velocity of the laser light passing through the center portion of the fθ lens and traveling onto the thermoreversible recording medium were respectively 14 W, and 1,000 mm/s, and the output and scanning linear velocity of the laser light passing through the peripheric portion of the fθ lens and traveling onto the thermoreversible recording medium were respectively 15.4 W, and was 1,000 mm/s.

—Image Erasing Step—

The image was erased from the thermoreversible recording medium by means of a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 30 mm), adjusting the radiation distance, scanning linear velocity, and spot diameter at 195 mm, 500 mm/s, and 3.0 mm, respectively. The outputs of the laser irradiating the center portion and peripheric portion of the fθ lens were adjusted to 16.5 W.

—Measurement of Image Line Width—

The measurement of the image line width was carried out in the following manner. At first, a gray scale (manufactured by Eastman Kodak Company) was read by a scanner (Canoscan4400, manufactured by Canon Inc.), a correlation was taken between the obtained digital gradation value and a gray level measured by a reflection densitometer (RD-914, manufactured by GretagMacbeth), then the digital gradation value obtained by reading the image recorded as mentioned above by means of the scanner was converted to the gray level, and the width when the gray level became 0.5 or more was calculated from the set pixel number (1,200 dpi) of the digital gradation value as a line width. Thereafter, obtained result was evaluated in the same manner as in Example 1. The results are shown in Tables 12-1 and 12-2.

—Measurement of Repeating Durability—

The image recording and image erasing were repeated, and after every 10 times, the image density of the erased portion was measured, and the repeated number of when the image density of the erased portion (the remained image) became 0.15 or more was determined. Then, the result was evaluated. The results are shown in Tables 12-1 and 12-2.

<<No. 16>>

Image recording and erasing were performed in the same manner as in <<No. 15>>, provided that output of the laser light passing through the peripheric portion of the fθ lens and traveling onto the thermoreversible recording medium was changed to 14 W in the image recording step.

<<No. 17>>

Image recording and erasing were performed in the same manner as in <<No. 15>>, provided that output of the laser light passing through the peripheric portion of the fθ lens and traveling onto the thermoreversible recording medium was changed to 13.3 W in the image recording step.

<<No. 18>>

Image recording and erasing were performed in the same manner as in <<No. 15>>, provided that output of the laser light passing through the peripheric portion of the fθ lens and traveling onto the thermoreversible recording medium was changed to 12.6 W in the image recording step.

<<No. 19>>

Image recording and erasing were performed in the same manner as in <<No. 15>>, provided that output of the laser light passing through the peripheric portion of the fθ lens and traveling onto the thermoreversible recording medium was changed to 11.6 W in the image recording step.

<<No. 20>>

Image recording and erasing were performed in the same manner as in <<No. 15>>, provided that output of the laser light passing through the peripheric portion of the fθ lens and traveling onto the thermoreversible recording medium was changed to 9.8 W in the image recording step.

Nos. 16 to 20 were evaluated in terms of the measurements of the image line width and repeating durability in the same manner as in No. 15. The results are shown in Tables 12-1 and 12-2 together with the result of No. 15.

TABLE 11-1

| | | | Center portion of fθ lens | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 15 | 110 | 100 | 1.3 | 0.014 | 14 | 1000 | Comp. |
| No. 16 | 100 | 100 | 1.3 | 0.014 | 14 | 1000 | Comp. |
| No. 17 | 95 | 100 | 1.3 | 0.014 | 14 | 1000 | Present invention |
| No. 18 | 90 | 100 | 1.3 | 0.014 | 14 | 1000 | Present invention |
| No. 19 | 83 | 100 | 1.3 | 0.014 | 14 | 1000 | Present invention |
| No. 20 | 70 | 100 | 1.3 | 0.014 | 14 | 1000 | Present invention |

TABLE 11-2

| | Peripheric portion of fθ lens | | | |
|---|---|---|---|---|
| | Energy E2 | Output P2 [W] | Scanning linear velocity V2 [mm/s] | |
| No. 15 | 0.015 | 15.4 | 1000 | Comp. |
| No. 16 | 0.014 | 14 | 1000 | Comp. |
| No. 17 | 0.013 | 13.3 | 1000 | Present invention |
| No. 18 | 0.013 | 12.6 | 1000 | Present invention |
| No. 19 | 0.012 | 11.6 | 1000 | Present invention |
| No. 20 | 0.01 | 9.8 | 1000 | Present invention |

TABLE 12-1

| | Repeating durability | | | |
|---|---|---|---|---|
| | Center portion of fθ lens (number) | Peripheric portion of fθ lens (number) | Evaluation | |
| No. 15 | 2000 | 610 | C | Comp. |
| No. 16 | 2000 | 1050 | C | Comp. |
| No. 17 | 2000 | 1790 | A | Present invention |
| No. 18 | 2000 | 1900 | A | Present invention |
| No. 19 | 2000 | 2240 | A | Present invention |
| No. 20 | 2000 | 2560 | A | Present invention |

TABLE 12-2

| | Image line width | | | |
|---|---|---|---|---|
| | Center portion of fθ lens (mm) | Peripheric portion of fθ lens (mm) | Evaluation | |
| No. 15 | 0.51 | 0.55 | A | Comp. |
| No. 16 | 0.51 | 0.51 | A | Comp. |
| No. 17 | 0.51 | 0.50 | A | Present invention |
| No. 18 | 0.51 | 0.49 | A | Present invention |
| No. 19 | 0.51 | 0.44 | B | Present invention |
| No. 20 | 0.51 | 0.41 | B | Present invention |

Example 8

<Adjustment of Scanning Linear Velocity>

<<No. 21>>

<Thermoreversible Recording Medium of Production Example 3>

—Image Recording Step—

The thermoreversible recording medium of Production Example 3 was used; a laser radiation distance from a fθ lens to the thermoreversible recording medium was adjusted to 158 mm using a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 150 mm, effective radius R: 30 mm) so that the light intensity distribution $I_1/I_2$ of the laser light passing through the center portion of the fθ lens and traveling onto the thermoreversible recording medium was adjusted to 1.3. An image was recorded on the thermoreversible recording medium under the conditions such that the output and scanning linear velocity of the laser light passing through the center portion of the fθ lens and traveling onto the thermoreversible recording medium were respectively 14 W, and 1,000 mm/s, and the output and scanning linear velocity of the laser light passing through the peripheric portion of the fθ lens and traveling onto the thermoreversible recording medium were respectively 14 W, and was 900 mm/s.

—Image Erasing Step—

The image was erased from the thermoreversible recording medium by means of a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 30 mm), adjusting the radiation distance, scanning linear velocity, and spot diameter at 195 mm, 500 mm/s, and 3.0 mm, respectively. The outputs of the laser irradiating the center portion and peripheric portion of the fθ lens were adjusted to 16.5 W.

—Measurement of Image Line Width—

The measurement of the image line width was carried out in the following manner. At first, a gray scale (manufactured by Eastman Kodak Company) was read by a scanner (Canoscan4400, manufactured by Canon Inc.), a correlation was taken between the obtained digital gradation value and a gray level measured by a reflection densitometer (RD-914, manufactured by GretagMacbeth), then the digital gradation value obtained by reading the image recorded as mentioned above by means of the scanner was converted to the gray level, and the width when the gray level became 0.5 or more was calculated from the set pixel number (1,200 dpi) of the digital gradation value as a line width. Thereafter, obtained result was evaluated in the same manner as in Example 1. The results are shown in Tables 14-1 and 14-2.

—Measurement of Repeating Durability—

The image recording and image erasing were repeated, and after every 10 times, the image density of the erased portion was measured, and the repeated number of when the image density of the erased portion (the remained image) became 0.15 or more was determined. Then, the result was evaluated. The results are shown in Tables 14-1 and 14-2.

<<No. 22>>

Image recording and erasing were performed in the same manner as in No. 21, provided that the scanning linear velocity of the laser light passing through the peripheric portion of the fθ lens and traveling onto the thermoreversible recording medium was changed to 1,050 mm/s in the image recording step.

<<No. 23>>

Image recording and erasing were performed in the same manner as in No. 21, provided that the scanning linear velocity of the laser light passing through the peripheric portion of the fθ lens and traveling onto the thermoreversible recording medium was changed to 1,100 mm/s in the image recording step.

<<No. 24>>

Image recording and erasing were performed in the same manner as in No. 21, provided that the scanning linear velocity of the laser light passing through the peripheric portion of the fθ lens and traveling onto the thermoreversible recording medium was changed to 1,200 mm/s in the image recording step.

<<No. 25>>

Image recording and erasing were performed in the same manner as in No. 21, provided that the scanning linear velocity of the laser light passing through the peripheric portion of the fθ lens and traveling onto the thermoreversible recording medium was changed to 1,420 mm/s in the image recording step.

Nos. 22 to 25 were evaluated in terms of the measurements of the image line width and repeating durability in the same manner as in No. 21. The results are shown in Tables 14-1 and 14-2 together with the result of No. 21.

TABLE 13-1

| | Center portion of fθ lens | | | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 21 | 100 | 90 | 1.3 | 0.014 | 14 | 1000 | Comp. |
| No. 16 | 100 | 100 | 1.3 | 0.014 | 14 | 1000 | Comp. |
| No. 22 | 100 | 105 | 1.3 | 0.014 | 14 | 1000 | Present invention |
| No. 23 | 100 | 111 | 1.3 | 0.014 | 14 | 1000 | Present invention |
| No. 24 | 100 | 120 | 1.3 | 0.014 | 14 | 1000 | Present invention |
| No. 25 | 100 | 142 | 1.3 | 0.014 | 14 | 1000 | Present invention |

TABLE 13-2

| | Peripheric portion of fθ lens | | | |
|---|---|---|---|---|
| | Energy E2 | Output P2 [W] | Scanning linear velocity V2 [mm/s] | |
| No. 21 | 0.016 | 14 | 900 | Comp. |
| No. 16 | 0.014 | 14 | 1000 | Comp. |
| No. 22 | 0.013 | 14 | 1050 | Present invention |
| No. 23 | 0.012 | 14 | 1110 | Present invention |
| No. 24 | 0.012 | 14 | 1200 | Present invention |
| No. 25 | 0.01 | 14 | 1420 | Present invention |

TABLE 14-1

| | Repeating durability | | | |
|---|---|---|---|---|
| | Center portion of fθ lens (number) | Peripheric portion of fθ lens (number) | Evaluation | |
| No. 21 | 2000 | 550 | C | Comp. |
| No. 16 | 2000 | 1050 | C | Comp. |
| No. 22 | 2000 | 1830 | A | Present invention |
| No. 23 | 2000 | 1900 | A | Present invention |
| No. 24 | 2000 | 2200 | A | Present invention |
| No. 25 | 2000 | 2620 | A | Present invention |

TABLE 14-2

| | Image line width | | | |
|---|---|---|---|---|
| | Center portion of fθ lens (mm) | Peripheric portion of fθ lens (mm) | Evaluation | |
| No. 21 | 0.51 | 0.54 | A | Comp. |
| No. 16 | 0.51 | 0.51 | A | Comp. |
| No. 22 | 0.51 | 0.50 | A | Present invention |
| No. 23 | 0.51 | 0.48 | A | Present invention |
| No. 24 | 0.51 | 0.45 | B | Present invention |
| No. 25 | 0.51 | 0.41 | B | Present invention |

Example 9

<Adjustment of Laser Output Conditions>

<<No. 26>>

<Thermoreversible Recording Medium of Production Example 3>

—Image Recording Step—

The thermoreversible recording medium of Production Example 3 was used; a laser radiation distance from a fθ lens to the thermoreversible recording medium was adjusted to 151 mm using a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 150 mm, effective radius R: 30 mm) so that the light intensity distribution $I_1/I_2$ of the laser light passing through the center portion of the fθ lens and traveling onto the thermoreversible recording medium was adjusted to 1.6. An image was recorded on the thermoreversible recording medium under the conditions such that the output and scanning linear velocity of the laser light passing through the center portion of the fθ lens and traveling onto the thermoreversible recording medium were respectively 11 W, and 1,000 mm/s, and the output and scanning linear velocity of the laser light passing through the peripheric portion of the fθ lens and traveling onto the thermoreversible recording medium were respectively 12.1 W, and was 1,000 mm/s.

—Image Erasing Step—

The thermoreversible recording medium of Production Example 1 was used, and the image was erased from the thermoreversible recording medium by means of a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 30 mm), adjusting the radiation distance, scanning linear velocity, and spot diameter at 195 mm, 500 mm/s, and 3.0 mm, respectively. The outputs of the laser irradiating the center portion and peripheric portion of the fθ lens were adjusted to 16.5 W.

—Measurement of Image Line Width—

The measurement of the image line width was carried out in the following manner. At first, a gray scale (manufactured by Eastman Kodak Company) was read by a scanner (Canoscan4400, manufactured by Canon Inc.), a correlation was taken between the obtained digital gradation value and a gray level measured by a reflection densitometer (RD-914, manufactured by GretagMacbeth), then the digital gradation value obtained by reading the image recorded as mentioned above by means of the scanner was converted to the gray level, and the width when the gray level became 0.5 or more was calculated from the set pixel number (1,200 dpi) of the digital gradation value as a line width. Thereafter, obtained result was evaluated in the same manner as in Example 1. The results are shown in Tables 16-1 and 16-2.

—Measurement of Repeating Durability—

The image recording and image erasing were repeated, and after every 10 times, the image density of the erased portion was measured, and the repeated number of when the image density of the erased portion (the remained image) became 0.15 or more was determined. Then, the result was evaluated. The results are shown in Tables 16-1 and 16-2.

<<No. 27>>

Image recording and erasing were performed in the same manner as in No. 26, provided that the output of the laser light passing through the peripheric portion of the fθ lens and traveling onto the thermoreversible recording medium was changed to 11 W in the image recording step.

<<No. 28>>

Image recording and erasing were performed in the same manner as in No. 26, provided that the output of the laser light passing through the peripheric portion of the fθ lens and traveling onto the thermoreversible recording medium was changed to 10.7 W in the image recording step.

<<No. 29>>

Image recording and erasing were performed in the same manner as in No. 26, provided that the output of the laser light passing through the peripheric portion of the fθ lens and traveling onto the thermoreversible recording medium was changed to 9.9 W in the image recording step.

<<No. 30>>

Image recording and erasing were performed in the same manner as in No. 26, provided that the output of the laser light passing through the peripheric portion of the fθ lens and traveling onto the thermoreversible recording medium was changed to 9.1 W in the image recording step.

<<No. 31>>

Image recording and erasing were performed in the same manner as in No. 26, provided that the output of the laser light passing through the peripheric portion of the fθ lens and traveling onto the thermoreversible recording medium was changed to 7.7 W in the image recording step.

Nos. 27 to 31 were evaluated in terms of the measurements of the image line width and repeating durability in the same manner as in No. 26. The results are shown in Tables 16-1 and 16-2 together with the result of No. 26.

TABLE 15-1

| | | | Center portion of fθ lens | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 26 | 110 | 100 | 1.6 | 0.011 | 11 | 1000 | Comp. |
| No. 27 | 100 | 100 | 1.6 | 0.011 | 11 | 1000 | Comp. |
| No. 28 | 97 | 100 | 1.6 | 0.011 | 11 | 1000 | Present invention |
| No. 29 | 90 | 100 | 1.6 | 0.011 | 11 | 1000 | Present invention |
| No. 30 | 83 | 100 | 1.6 | 0.011 | 11 | 1000 | Present invention |
| No. 31 | 70 | 100 | 1.6 | 0.011 | 11 | 1000 | Present invention |

TABLE 15-2

| | Peripheric portion of fθ lens | | | |
|---|---|---|---|---|
| | Energy E2 | Output P2 [W] | Scanning linear velocity V2 [mm/s] | |
| No. 26 | 0.012 | 12.1 | 1000 | Comp. |
| No. 27 | 0.011 | 11 | 1000 | Comp. |
| No. 28 | 0.011 | 10.7 | 1000 | Present invention |
| No. 29 | 0.01 | 9.9 | 1000 | Present invention |
| No. 30 | 0.009 | 9.1 | 1000 | Present invention |

TABLE 15-2-continued

| | Peripheric portion of fθ lens | | | |
|---|---|---|---|---|
| | Energy E2 | Output P2 [W] | Scanning linear velocity V2 [mm/s] | |
| No. 31 | 0.08 | 7.7 | 1000 | Present invention |

TABLE 16-1

| | Repeating durability | | | |
|---|---|---|---|---|
| | Center portion of fθ lens (number) | Peripheric portion of fθ lens (number) | Evaluation | |
| No. 26 | 1300 | 320 | C | Comp. |
| No. 27 | 1300 | 990 | C | Comp. |
| No. 28 | 1300 | 1200 | A | Present invention |
| No. 29 | 1300 | 1410 | A | Present invention |
| No. 30 | 1300 | 1840 | A | Present invention |
| No. 31 | 1300 | 1000 | A | Present invention |

TABLE 16-2

| | Image line width | | | |
|---|---|---|---|---|
| | Center portion of fθ lens (mm) | Peripheric portion of fθ lens (mm) | Evaluation | |
| No. 26 | 0.38 | 0.40 | A | Comp. |
| No. 27 | 0.38 | 0.38 | A | Comp. |
| No. 28 | 0.38 | 0.38 | A | Present invention |
| No. 29 | 0.38 | 0.36 | A | Present invention |
| No. 30 | 0.38 | 0.29 | B | Present invention |
| No. 31 | 0.38 | 0.25 | B | Present invention |

Example 10

<Adjustment of Scanning Linear Velocity>

<<No. 32>>

<Thermoreversible Recording Medium of Production Example 3>

—Image Recording Step—

The thermoreversible recording medium of Production Example 3 was used; a laser radiation distance from a fθ lens to the thermoreversible recording medium was adjusted to 151 mm using a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 150 mm, effective radius R: 30 mm) so that the light intensity distribution $I_1/I_2$ of the laser light passing through the center portion of the fθ lens and traveling onto the thermoreversible recording medium was adjusted to 1.6. An image was recorded on the thermoreversible recording medium under the conditions such that the output and scanning linear velocity of the laser light passing through the center portion of the fθ lens and traveling onto the thermoreversible recording medium were respectively 11 W, and 1,000 mm/s, and the output and scanning linear velocity of the laser light passing through the peripheric portion of the fθ lens and traveling onto the thermoreversible recording medium were respectively 11 W, and was 900 mm/s.

—Image Erasing Step—

The image was erased from the thermoreversible recording medium by means of a fiber coupling semiconductor laser LIMO25-F100-DL808 manufactured by LIMO GmbH (a center wavelength: 808 nm) which was equipped, in a pathway of laser light, at least with an aspherical lens that was an optical lens configured to control a light intensity distribution of laser light, a galvanometer mirror configured to scan the laser light, and the condenser fθ lens (focal length: 189 mm, effective radius R: 30 mm), adjusting the radiation distance, scanning linear velocity, and spot diameter at 195 mm, 500 mm/s, and 3.0 mm, respectively. The outputs of the laser irradiating the center portion and peripheric portion of the fθ lens were adjusted to 16.5 W.

—Measurement of Image Line Width—

The measurement of the image line width was carried out in the following manner. At first, a gray scale (manufactured by Eastman Kodak Company) was read by a scanner (Canoscan4400, manufactured by Canon Inc.), a correlation was taken between the obtained digital gradation value and a gray level measured by a reflection densitometer (RD-914, manufactured by GretagMacbeth), then the digital gradation value obtained by reading the image recorded as mentioned above by means of the scanner was converted to the gray level, and the width when the gray level became 0.5 or more was calculated from the set pixel number (1,200 dpi) of the digital gradation value as a line width. Thereafter, obtained result was evaluated in the same manner as in Example 1. The results are shown in Tables 18-1 and 18-2.

—Measurement of Repeating Durability—

The image recording and image erasing were repeated, and after every 10 times, the image density of the erased portion was measured, and the repeated number of when the image density of the erased portion (the remained image) became 0.15 or more was determined. Then, the result was evaluated. The results are shown in Tables 18-1 and 18-2.

<<No. 33>>

Image recording and erasing were performed in the same manner as in No. 32, provided that the scanning linear velocity of the laser light passing through the peripheric portion of the fθ lens and traveling onto the thermoreversible recording medium was changed to 1,030 mm/s in the image recording step.

<<No. 34>>

Image recording and erasing were performed in the same manner as in No. 32, provided that the scanning linear velocity of the laser light passing through the peripheric portion of the fθ lens and traveling onto the thermoreversible recording medium was changed to 1,100 mm/s in the image recording step.

<<No. 35>>

Image recording and erasing were performed in the same manner as in No. 32, provided that the scanning linear velocity of the laser light passing through the peripheric portion of the fθ lens and traveling onto the thermoreversible recording medium was changed to 1,200 mm/s in the image recording step.

<<No. 36>>

Image recording and erasing were performed in the same manner as in No. 32, provided that the scanning linear velocity of the laser light passing through the peripheric portion of the fθ lens and traveling onto the thermoreversible recording medium was changed to 1,420 mm/s in the image recording step.

Nos. 33 to 36 were evaluated in terms of the measurements of the image line width and repeating durability in the same manner as in No. 32. The results are shown in Tables 18-1 and 18-2 together with the result of No. 32.

TABLE 17-1

| | Center portion of fθ lens | | | | | | |
|---|---|---|---|---|---|---|---|
| | (P2/P1) × 100 [%] | (V2/V1) × 100 [%] | Light intensity distribution $I_1/I_2$ | Energy E1 | Output P1 [W] | Scanning linear velocity V1 [mm/s] | |
| No. 32 | 100 | 90 | 1.6 | 0.011 | 11 | 1000 | Comp. |
| No. 27 | 100 | 100 | 1.6 | 0.011 | 11 | 1000 | Comp. |
| No. 33 | 100 | 103 | 1.6 | 0.011 | 11 | 1000 | Present invention |
| No. 34 | 100 | 111 | 1.6 | 0.011 | 11 | 1000 | Present invention |
| No. 35 | 100 | 120 | 1.6 | 0.011 | 11 | 1000 | Present invention |
| No. 36 | 100 | 142 | 1.6 | 0.011 | 11 | 1000 | Present invention |

TABLE 17-2

| | Peripheric portion of fθ lens | | | |
|---|---|---|---|---|
| | Energy E2 | Output P2 [W] | Scanning linear velocity V2 [mm/s] | |
| No. 32 | 0.012 | 11 | 900 | Comp. |
| No. 27 | 0.011 | 11 | 1000 | Comp. |
| No. 33 | 0.011 | 11 | 1030 | Present invention |
| No. 34 | 0.01 | 11 | 1110 | Present invention |
| No. 35 | 0.009 | 11 | 1200 | Present invention |
| No. 36 | 0.08 | 11 | 1420 | Present invention |

TABLE 18-1

| | Repeating durability | | | |
|---|---|---|---|---|
| | Center portion of fθ lens (number) | Peripheric portion of fθ lens (number) | Evaluation | |
| No. 32 | 1300 | 300 | C | Comp. |
| No. 27 | 1300 | 990 | C | Comp. |

TABLE 18-1-continued

| | Repeating durability | | | |
|---|---|---|---|---|
| | Center portion of fθ lens (number) | Peripheric portion of fθ lens (number) | Evaluation | |
| No. 33 | 1300 | 1180 | A | Present invention |
| No. 34 | 1300 | 1560 | A | Present invention |
| No. 35 | 1300 | 1910 | A | Present invention |

TABLE 18-1-continued

| | Repeating durability | | | |
|---|---|---|---|---|
| | Center portion of fθ lens (number) | Peripheric portion of fθ lens (number) | Evaluation | |
| No. 36 | 1300 | 2230 | A | Present invention |

TABLE 18-2

| | Image line width | | | |
|---|---|---|---|---|
| | Center portion of fθ lens (mm) | Peripheric portion of fθ lens (mm) | Evaluation | |
| No. 32 | 0.38 | 0.40 | A | Comp. |
| No. 27 | 0.38 | 0.38 | A | Comp. |
| No. 33 | 0.38 | 0.38 | A | Present invention |
| No. 34 | 0.38 | 0.36 | A | Present invention |
| No. 35 | 0.38 | 0.29 | B | Present invention |
| No. 36 | 0.38 | 0.26 | B | Present invention |

Example 11

—Evaluation on Moving Object—

The image processing was carried out under the conditions of No. 3 of Example 1 on the thermoreversible recording medium of Production Example 1, which was attached to a plastic box, while the plastic box was placed and transported on a conveyer belt at the traveling speed of 10 m/min. As a result, an image was uniformly recorded on the thermoreversible recording medium attached to the moving object, and the image was also uniformly erased. Moreover, the results of the repeating durability and image ling width thereof were similar to that of No. 3.

As a comparison, the image processing was carried out under the conditions of No. 2 of Example 1 on the thermoreversible recording medium of Production Example 1, which was attached to a plastic box, while the plastic box was placed and transported on a conveyer belt at the traveling speed of 10 m/min. As a result, an image was uniformly recorded on the thermoreversible recording medium attached to the moving object, and the image was also uniformly erased. Moreover, the results of the repeating durability and image ling width thereof were similar to that of No. 2.

The image processing method and image processing device of the present invention are capable of repetitively performing image recording and image erasing to a thermoreversible recording medium such as a label attached to a container such as a cardboard box or a plastic container in a non-contact system. In addition, the image processing method and image processing device of the present invention are capable of suppressing the deterioration of the thermoreversible recording medium due to the repetitive use, and are especially suitably used for distribution and delivery systems.

What is claimed is:

1. An image processing method comprising:

delivering laser light to a thermoreversible recording medium so as to heat the thermoreversible recording medium and record an image thereon, the thermoreversible recording medium reversibly changing a transparency or tone thereof depending on a temperature thereof; and heating the thermoreversible recording medium so as to erase the image recorded on the thermoreversible recording medium, wherein the delivering is carried out using an image processing device which comprises:

a laser light emitting unit;

a light scanning unit disposed on a plane onto which laser light emitted from the laser light emitting unit is delivered;

a light intensity distribution adjusting unit configured to change a light intensity distribution of the laser light; and a fθ lens configured to condense the laser light, and wherein energy of the laser light which passes through a peripheric portion of the fθ lens and travels onto the thermoreversible recording medium is lower than energy of the laser light which passes through a center portion of the fθ lens and travels onto the thermoreversible recording medium.

2. The image processing method according to claim 1, wherein output P2 of the laser light which passes through the peripheric portion of the fθ lens and travels onto the thermoreversible recording medium is adjusted to be lower than output P1 of the laser light which passes through the center portion of the fθ lens and travels onto the thermoreversible recording medium.

3. The image processing method according to claim 2, wherein the value of (P2/P1)×100 is 80% to 99%.

4. The image processing method according to claim 1, wherein a scanning linear velocity V2 of the laser light which passes through the peripheric portion of the fθ lens and travels onto the thermoreversible recording medium is adjusted to be faster than a scanning linear velocity V1 of the laser light which passes through the center portion of the fθ lens and travels onto the thermoreversible recording medium.

5. The image processing method according to claim 4, wherein the value of (V2/V1)×100 is 101% to 120%.

6. The image processing method according to claim 1, wherein in both the irradiating and the heating, or in the irradiating or the heating, a light intensity distribution of the laser light which passes through the center portion of the fθ lens and travels onto the thermoreversible recording medium satisfies the following formula 1:

$$0.40 \leqq I_1/I_2 \leqq 2.00 \qquad \text{Formula 1}$$

where $I_1$ is a light intensity at a center part of the laser light delivered onto the thermoreversible recording medium, and $I_2$ is a light intensity at a plane which defines 80% of a total radiation energy of the laser beam delivered onto the thermoreversible recording medium in the light intensity distribution.

7. The image processing method according to claim 1, wherein the thermoreversible recording medium comprises a support and a thermoreversible recording layer disposed on the support, and wherein the thermoreversible recording layer is configured to reversibly change a transparency or tone thereof at a first specified temperature and a second specified temperature which is higher than the first specified temperature.

8. The image processing method according to claim 7, wherein the thermoreversible recording layer comprises a resin and a low-molecular organic material.

9. The image processing method according to claim 7, wherein the thermoreversible recording layer comprises a leuco dye and a reversible developer.

10. The image processing method according to claim 1, which is used for image recording, or image erasing, or both of image recording and image erasing, on a moving object.

11. An image processing device comprising:

a laser light emitting unit;

a light scanning unit disposed on a plane where laser light is traveled from the laser light irradiating unit;

a light intensity distribution adjusting unit configured to change a light intensity distribution of the laser light; and a fθ lens configured to condense the laser light, and wherein energy of the laser light which passes through a peripheric portion of the fθ lens and travels onto the thermoreversible recording medium is lower than energy of the laser light which passes through a center portion of the fθ lens and travels onto the thermoreversible recording medium, wherein the image processing device is used for an image processing method, which comprises:

irradiating a thermoreversible recording medium with laser light so as to heat the thermoreversible recording medium and record an image on the thermoreversible recording medium, the thermoreversible recording medium reversibly changing a transparency or tone thereof depending on a temperature; and heating the thermoreversible recording medium so as to erase the image recorded on the thermoreversible recording medium.

12. The image processing device according to claim 11, wherein the light intensity adjusting unit is at least one selected from the group consisting of an aspherical lens, a diffraction optical element, and a fiber coupling.

13. The image processing device according to claim 11, wherein the light scanning unit is a galvanometer mirror.

* * * * *